US007918588B2

(12) United States Patent
Gordin et al.

(10) Patent No.: US 7,918,588 B2
(45) Date of Patent: Apr. 5, 2011

(54) FULL OR NEAR-FULL CUT-OFF VISOR FOR LIGHT FIXTURE

(75) Inventors: Myron K. Gordin, Oskaloosa, IA (US); Joe P. Crookham, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 296 days.

(21) Appl. No.: 12/114,553

(22) Filed: May 2, 2008

(65) Prior Publication Data

US 2008/0273335 A1 Nov. 6, 2008

Related U.S. Application Data

(60) Provisional application No. 60/915,587, filed on May 2, 2007.

(51) Int. Cl.
*F21V 7/00* (2006.01)
*F21V 7/07* (2006.01)

(52) U.S. Cl. ..... 362/296.01; 362/296.05; 362/341; 362/297

(58) Field of Classification Search ..... 362/296.01, 362/296.05–296.08, 341, 344, 303, 346, 362/302, 297–299
See application file for complete search history.

(56) References Cited

U.S. PATENT DOCUMENTS

| | | | | |
|---|---|---|---|---|
| 1,104,330 | A | | 7/1914 | Townsend |
| 1,325,619 | A | | 12/1919 | Glemmans |
| 1,559,464 | A | | 10/1925 | Sachse |
| 1,560,408 | A | | 11/1925 | Charlebois |
| 1,560,948 | A | | 11/1925 | Smothers |
| 2,175,918 | A | | 10/1939 | Sauer |
| D179,027 | S | | 10/1956 | New |
| 3,696,715 | A | | 10/1972 | Jedlicka |
| 3,780,285 | A | | 12/1973 | Appeldorn et al. |
| D295,326 | S | | 4/1988 | Dahlgren |
| D295,563 | S | | 5/1988 | Speck |
| 4,947,303 | A | * | 8/1990 | Gordin et al. ..... 362/261 |
| 5,012,398 | A | | 4/1991 | Jones et al. |
| 5,075,808 | A | * | 12/1991 | Johnson ..... 360/98.08 |
| 5,161,883 | A | | 11/1992 | Gordin et al. |
| 5,211,473 | A | | 5/1993 | Gordin et al. |
| 5,313,379 | A | | 5/1994 | Lemons et al. |
| 5,400,223 | A | | 3/1995 | Speaker et al. |
| 5,465,199 | A | | 11/1995 | Bray et al. |
| D389,268 | S | | 1/1998 | Kay |
| 5,707,142 | A | | 1/1998 | Gordin |
| 5,730,521 | A | | 3/1998 | Spink et al. |

(Continued)

OTHER PUBLICATIONS

Paulin, D., "Full Cutoff Lighting: The Benefits", originally published in LD+A, p. 54 (2001).

(Continued)

*Primary Examiner* — Bao Q Truong
(74) *Attorney, Agent, or Firm* — McKee, Voorhees & Sease, P.L.C.

(57) ABSTRACT

A wide area lighting fixture includes a relatively large visor extending from a bowl shaped fixture reflector. The distal portion of the visor extends relatively far outwardly and downwardly and around the fixture opening. In operating position, the visor blocks most or all off field direct view of the light source in the fixture. Optionally a light absorbing surface or insert can be placed at the very bottom of the bowl shaped reflector to absorb or otherwise stop light that otherwise might go off-field to further control spill light, glare, and sky glow or uplight.

42 Claims, 27 Drawing Sheets

U.S. PATENT DOCUMENTS

| | | | | |
|---|---|---|---|---|
| 5,800,038 | A | 9/1998 | McCool | |
| 5,816,691 | A | 10/1998 | Gordin et al. | |
| 5,856,721 | A | 1/1999 | Gordin et al. | |
| D432,693 | S | 10/2000 | Wachter et al. | |
| 6,203,176 | B1 | 3/2001 | Gordin | |
| 6,502,965 | B1 | 1/2003 | Bradford | |
| D488,878 | S | 4/2004 | Ward | |
| D583,500 | S | 12/2008 | Gordin | |
| 2006/0176704 | A1 | 8/2006 | Gordin et al. | |
| 2006/0187663 | A1 * | 8/2006 | Gordin et al. | 362/350 |

OTHER PUBLICATIONS

IESNA RP-33-99 "Lighting for Exterior Environments, An IESNA Recommended Practice", published by Illuminating Engineering Society of North America, 120 Wall Street, New York, New York 10005, p. 17 (1999).

"Light Pollution", NLPIP Lighting Answers, vol. 7, Issue 2, Mar. 2003 (revised Feb. 2007) 20 pages, retrieved Feb. 12, 2007.

* cited by examiner (FLAT PATTERN IN PRE-FORMED PLAN VIEW)

(FLAT PATTERN IN PRE-FORMED PLAN VIEW)

(FLAT PATTERN VIEW)

(FORMED VIEW)

FULL OR NEAR-FULL CUT-OFF VISOR FOR LIGHT FIXTURE

CROSS-REFERENCE TO RELATED APPLICATIONS

This application claims priority under 35 U.S.C. §119 to provisional application Ser. No. 60/915,587 filed May 2, 2007, herein incorporated by reference in its entirety.

BACKGROUND OF THE INVENTION

A. Field of the Invention

The present invention relates to apparatus and methods for light pollution (e.g., glare, spill, and sky glow) control for high intensity discharge lighting fixtures, in particular, for wide area lighting, such as sports lighting and achieve full or near full cut-off at or near normal aiming angles for such lighting fixtures.

B. Problems in the Art

What is sometimes called light pollution (e.g., glare, spill light, and sky glow or uplight) is of significant concern for wide area lighting. Adjacent home and business owners many times complain about light pollution from wide area lighting systems. These types of light pollution are well-known in the art and discussed in such publications as the Illumination Engineering Society of North America (IESNA), *Sports and Recreational Area Lighting*, publication RP-6-01; Bullough, J. D. (2002), "*Interpreting Outdoor Luminaire Cutoff Classification*" Lighting Design+Application 32(7):44-46; Commission Internationale de l'Eclairage (CIE), "*Guide on the limitation of the effects of obtrusive light from outdoor lighting installations*", Report TC5.12, Vienna; and Commission Internationale de l'Eclairage (CIE) (1997) "*Guidelines for Minimizing Sky Glow*" Vienna; Illuminating Engineering Society of North America (IESNA), 2000. *American National Standard Practice for Roadway Lighting*, ANSI/IESNA RP-8-00, New York; Illuminating Engineering Society of North America, Illuminating Engineering Society of North America (IESNA), 1999, *Recommended Practice for Outdoor and Environmental Lighting*, IESNA RP-33-99, New York; Illuminating Engineering Society of North America; Rea, M. S., ed. 2000, *IESNA Lighting Handbook: Reference and Application,* 9th edition, New York: Illuminating Engineering Society of North America; which all are incorporated by reference herein.

The owner of the present application has patented a variety of ways to address these types of problems. Examples are: U.S. Pat. Nos. 4,947,303; 5,161,883; 5,211,473; 5,816,691; 5,856,721; and 6,203,176, all of which are incorporated by reference herein.

Most times there is a delicate balance between light pollution control methods and avoiding significant reduction in the amount of useable light output from such fixtures. Of course, complete light pollution control can be achieved by essentially blocking most light from a lighting fixture. This is impractical, however, as it effectively wastes the energy used to produce light from that fixture, and requires many such fixtures to provide adequate light to most targets. Another method is aiming fixtures at steep angles down from horizontal, however this greatly limits the fixture's use because many applications, including sports lighting, require projecting light from the fixtures at angles to cover parts of the target area (e.g., sports field) that are substantial distances away from the fixtures and, as such, must be aimed at shallower angles.

The above-mentioned patents present several ways in which this balance is approached. Many of the patents reduce light pollution without substantial decrease (and sometimes increase) of usable light to the target area. The laws of physics, however, make it difficult to achieve what is known as "full cut-off", or even near full cut-off, while maintaining reasonable efficiency from the fixture.

There are certain cases, though, where drastic light pollution control is needed. With certain fixtures that are aimed in sensitive directions, the present state of the art for light pollution control uses fixtures and techniques that tend to materially diminish light intensity usable to the target.

There is, and continues to be, a need in the art for light pollution control solutions, including those that require what might be called drastic light pollution control; perhaps for a few fixtures with special light pollution control needs.

For example, there are times when full cut-off is needed, (e.g., to meet full cut-off technical specifications, such as for example, the IESNA definition of what is considered full light cut-off (see IESNA Publication RP-33-99, entitled *Recommended Practice for Outdoor and Environmental Lighting* (copyright 1999), p. 17, incorporated by reference herein). As can be seen in the definition, "full light cut-off" is defined as a fixture that produces zero candela intensity above a certain plane (i.e., 90° above nadir) and no more than 100 candela (cd) per 1000 lamp lumens at a vertical angle of 80° above nadir (see FIG. 12 herein). For typical sports lighting aiming axis, the plane is normally considered horizontal. The definition in the published "IESNA Lighting Handbook 9th edition" from IESNA, incorporated by reference herein, states no intensity can extend above, in that case, a horizontal plane at or near the fixture. Therefore, a fixture that meets this definition must prevent light from the source that otherwise would tend to travel above the plane from traveling above that plane.

As mentioned, the long-time problem with full cut-off fixtures is they tend to severely block or absorb light from the light source of the fixture to meet the full cut-off definition, or they must be aimed steeply downward. The approach is that it is much easier to achieve full cut-off if little light comes out of the fixture and/or it is aimed at steep angles down to the ground. The fixture in the diagram of FIG. 12 herein is essentially pointed straight down (to nadir or 90° down from horizontal) and has an enclosure around the light source except for a bottom opening. As can be appreciated, the enclosure prevents direct light from traveling above the horizontal plane through the fixture. Even light reflecting from an interior surface of the fixture, a lens over the opening, or other parts of the enclosure would have a hard time traveling above that plane. However, as mentioned previously, it is not very often that such fixtures are practical for large area lighting, such as sports lighting; fixtures which need to throw light over a greater distance (see FIGS. 6A-C) to project light to different areas of a field. Typical aiming angles for such lighting fixtures are 45° to 60° above nadir (or 30° to 45° down from horizontal) and sometimes 60° to 75° above nadir (15° to 45° down from horizontal). As can be appreciated, this tilts the fixture more in a direction parallel to the horizontal plane through the fixture, thus making it much more difficult to achieve the full cut-off definition, or even near full cut-off. Both direct light and reflected light from the fixture are problems in this regard.

As also mentioned, the technique of blocking a substantial amount of light from the fixture to try to achieve some level of cut-off is very inefficient. For the amount of electricity used, a low ratio of useable light to the target is normally produced. This inefficiency tends to increase as the fixture is modified more towards full cut-off.

Therefore, there continues to be a need in the art for solutions to a variety of lighting problems, specifically those that need a substantial amount of full or near full light cut-off. There are also times when near full cut-off is needed at normal sports lighting type aiming angles.

BRIEF SUMMARY OF THE INVENTION

It is therefore a principal object, feature, aspect, or objective of the present invention to improve over or solve problems or deficiencies in the art. Another object, feature, aspect, or objective is to provide a beneficial light pollution light option for high intensity discharge wide area lighting fixtures.

It is a further object of the present invention to provide an apparatus and method which can be configured to achieve full or near full light cut-off while meeting light projection needs of wide area lighting applications.

It is a further object to provide a method and apparatus which can be adjusted for level of cut-off depending upon the specific application and configuration.

These and other objects, features, advantages and aspects of the invention will become more apparent with reference to the accompanying specification and claims.

One aspect of the invention includes a visor that extends from a generally bowl shaped reflector of an HID wide area lighting fixture. The visor extends a substantial distance outwardly and down over the front and sides of the fixture to achieve at least near full cut-off of light beyond a certain aiming angle from the fixture.

An optional feature includes an insert or area configured in the bottom of the bowl shaped reflector to further reduce light projecting beyond a certain angle from the fixture when in operation, achieving "full cut-off" status at certain aiming angles.

DETAILED DESCRIPTION OF THE EXEMPLARY EMBODIMENTS

Figure 1A:
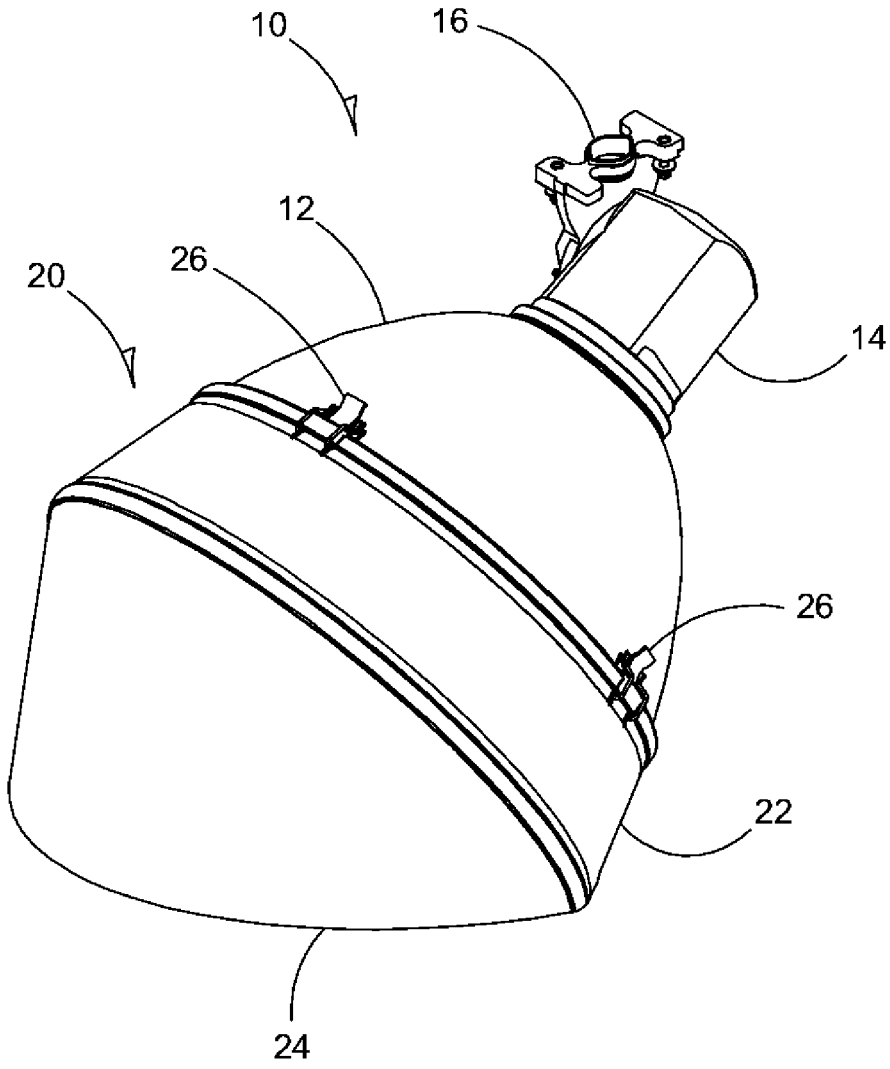
FIGS. 1A-D are different perspective exterior views of a full or near full cut-off exemplary embodiment light fixture within a range of conventional operating positions for the fixture, according to one aspect of the present invention.
Figure 1B:
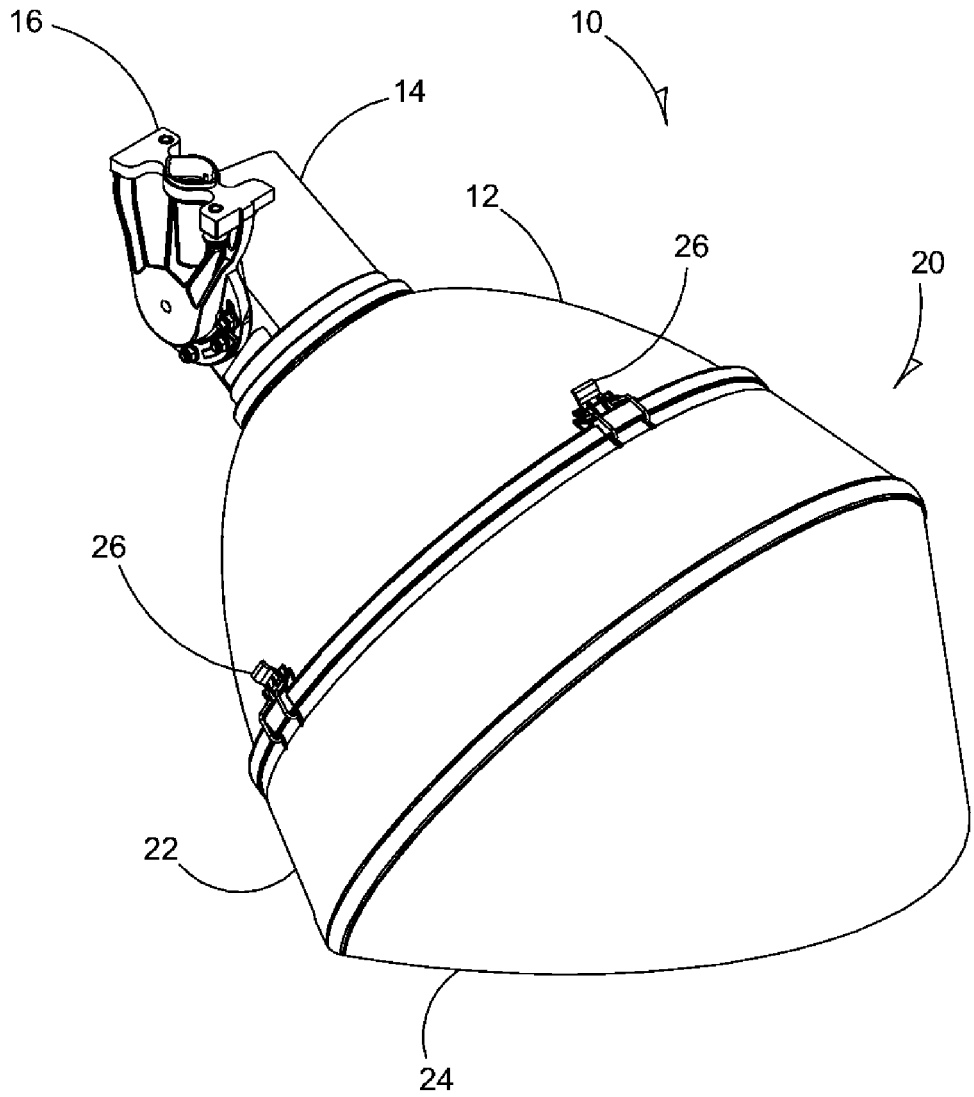
Figure 1C:
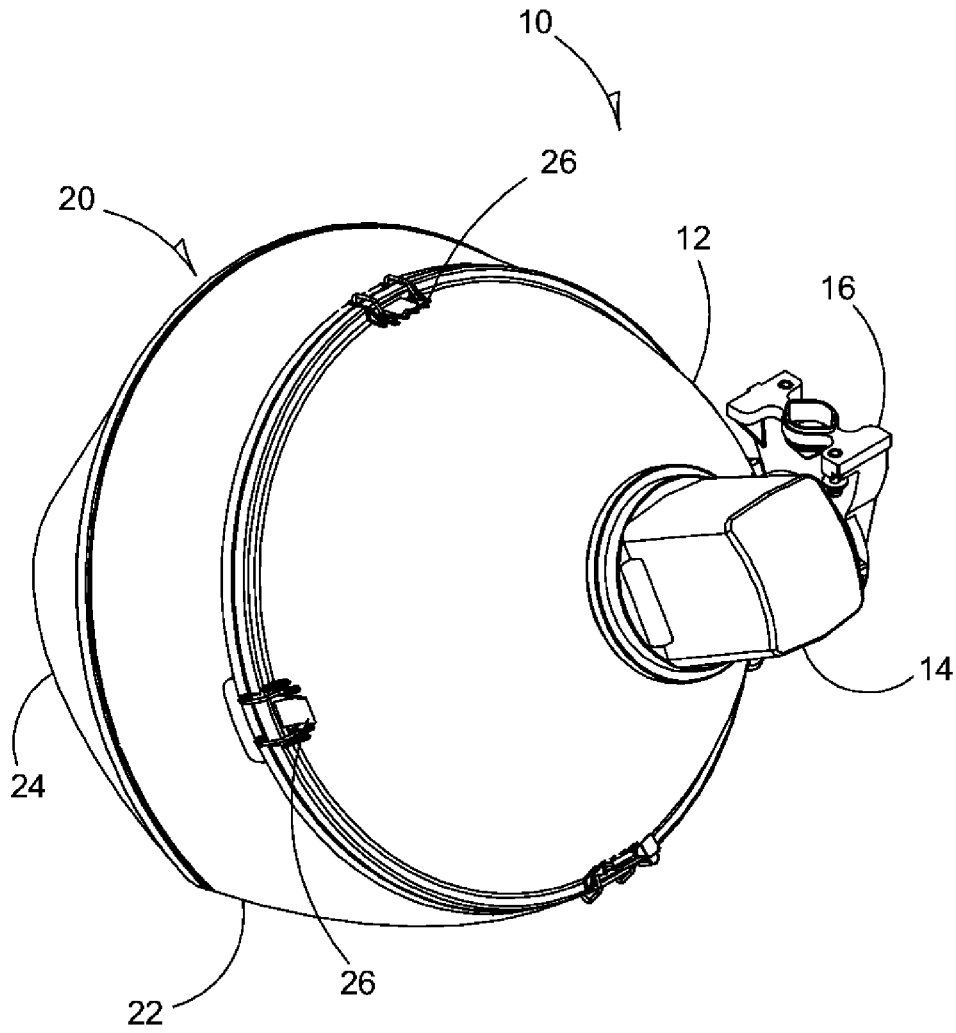
Figure 1D:
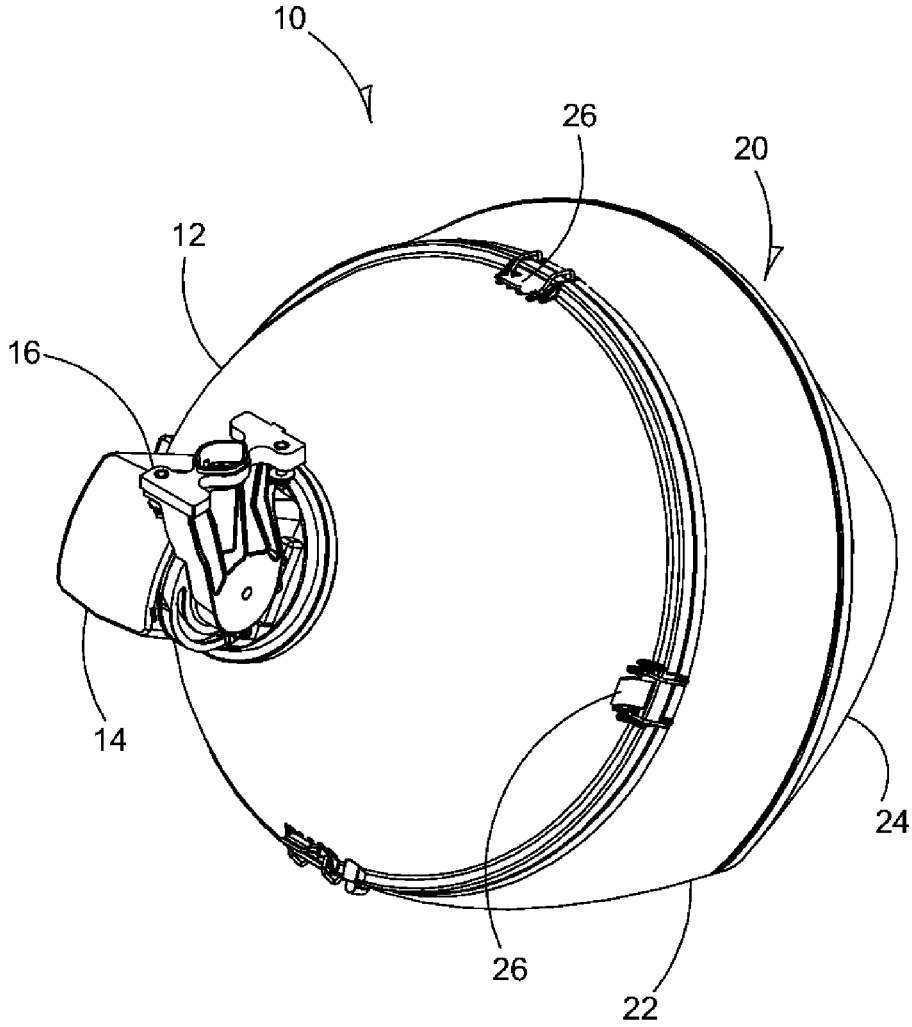

For a better understanding of the invention, examples of forms the invention can take will now be described in detail. It is to be understood these are but a few examples of forms the invention and are not inclusive or exclusive.

The patents previously mentioned or incorporated by reference show other light pollution light configurations. Some include a visor and a reflector insert. The differences between them and the exemplary embodiments of the present invention will be emphasized below. For purposes of this description, the term "full cut off" refers to its definition in IESNA Publication RP-33-99, page 17.

A. Exemplary Embodiment One

FIGS. 1A-11C show a full cut-off fixture 10 according to an exemplary embodiment of the invention. Commercially available bowl shaped fixture 12 with lamp cone or mogul 14 and mounting elbow 16 (e.g., Green Generation Lighting® fixture, also referred to sometimes as LSG™ or Light Structure Green™ fixture or lighting system from Musco Corporation, Oskaloosa, Iowa USA) is adapted to hold an HID single-ended screw-in lamp 11 (with arc tube 13) and produce a generally controlled, concentrated, asymmetrical beam to a target (e.g., sports field 42 in FIG. 7). Reflector 12 includes a bowl-shaped, highly reflective interior surface 29. A glass lens (not shown) covers the bowl-shaped portion 12. Other similar fixture configurations are currently available that contain an axially mounted lamp and create an asymmetrical beam.

The following modifications are included in fixture 10 to achieve full cut-off at conventional sports lighting aiming angles, e.g., roughly around 30° down from horizontal (or 60° up from nadir). This is typically 15°-45° down from horizontal, but some fixtures can be outside this range.

1. Visor

First, the exemplary embodiment of FIGS. 1A-11C includes a relatively large visor 20 having a base 22 and a distal end 24. As shown in FIG. 5, locking hardware 26 allows it to removably latch to complementary structure 28 on bowl shaped portion 12. Visor 20 has an outer metal shell in the shape shown in FIGS. 1A-D, 2, 3, and 4. It can be appreciated how it extends substantially from reflector 12, including down to almost the very bottom reflector 12. It essentially wraps around the lens of fixture 10 to at or near 360°, although the amount visor 20 extends from the opening to reflector 12 varies. Compare visor 20 with visors 70A and B of U.S. published application US 2006/0181875 A1, incorporated by reference herein, which have sides that do not extend all the way around the front of the reflector frame. The Figures herein illustrating cut-off fixture 10 are generally to scale.

2. Non-Reflective Insert for Main Reflector

Figure 2:
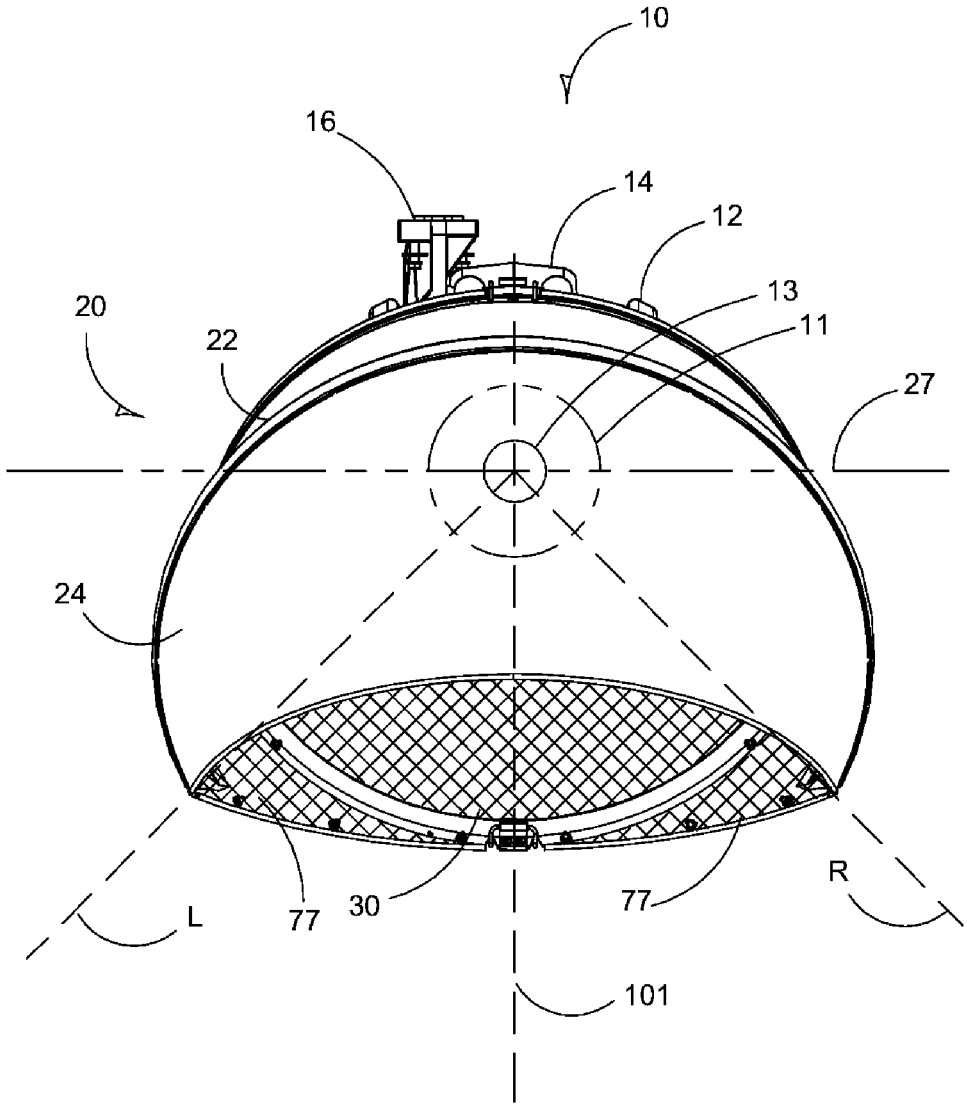
FIG. 2 is a front elevation view of the fixture of FIG. 1A.
Figure 3:
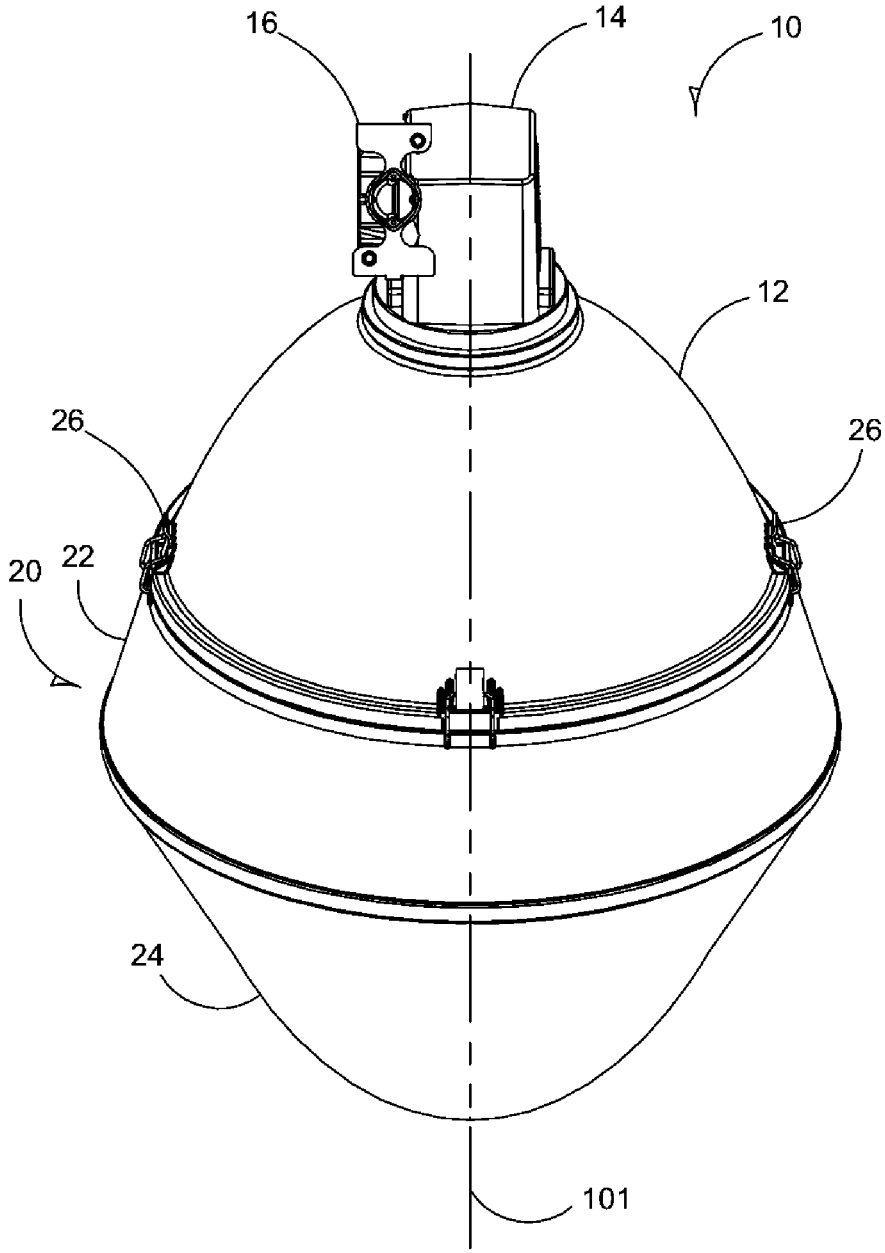
FIG. 3 is a top plan view of the fixture of FIG. 1A.
Figure 11A:
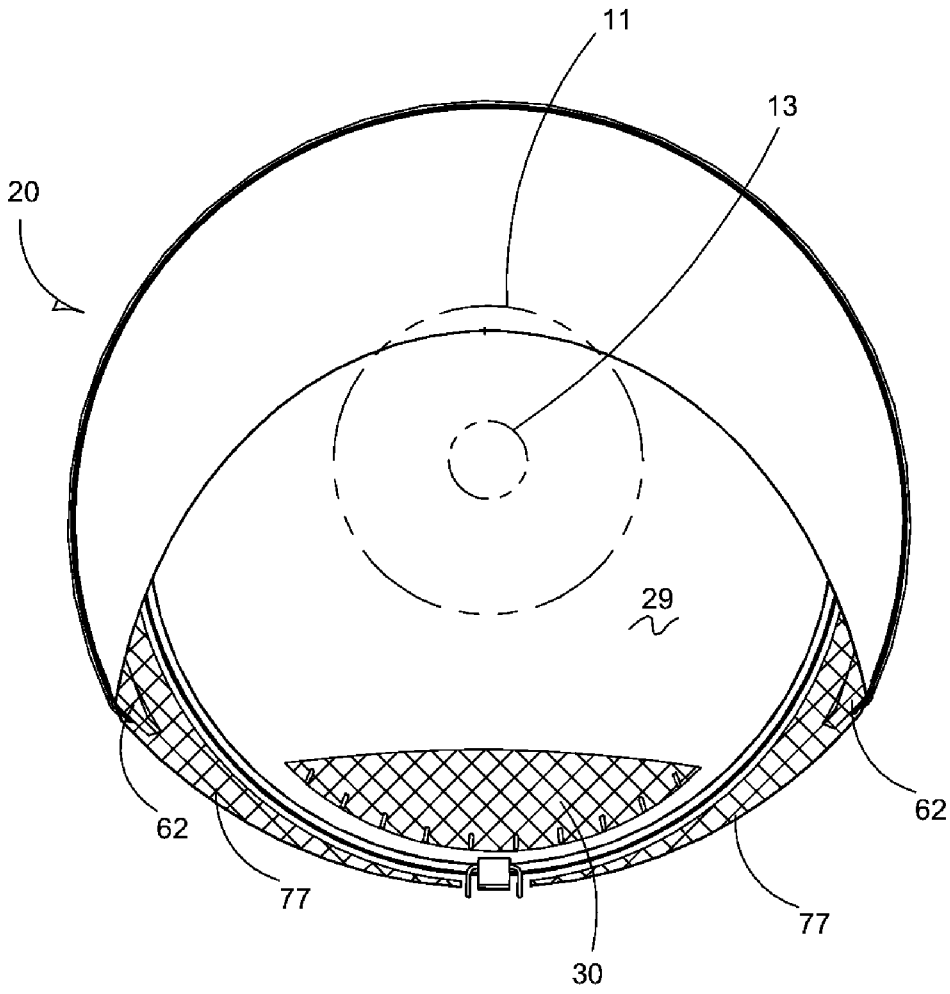
FIG. 11A is a front elevation view of the visor of FIG. 9A installed on a fixture including an insert in the bottom hemisphere of the fixture according to a full cut-off exemplary embodiment of the invention.

Secondly, a small non-reflective piece 30 has multiple mounting slots 32 that mount on corresponding bosses 34 on the interior of bowl-shaped reflector frame 12 (see, e.g., FIGS. 2, 5, 11A and B). The outer-facing surface of insert 30 has been cross-hatched in the Figures to indicate it is black. It could be completely flat black. But it could be other colors including, but not limited to, flat gray. Cross hatching of insert 30, as well as other surfaces of fixture 10, is intended to indicate they are flat black or some other color, texture, or treatment that absorbs or does not reflect light in a highly controllable manner. In this embodiment, the outward facing surface of piece 30 is painted non-reflective black (as indicated by the cross hatching) to greatly reduce or eliminate reflection from that part of fixture 10 (see also FIG. 11A). As can be appreciated, there are other colors or surfaces that can substantially absorb light that could alternatively be used. Also, instead of an add-on insert, that portion of the interior of reflector 12 could be painted or otherwise configured to absorb light or attenuate controlled reflection of light.

3. Non-Reflective Interior Visor Surfaces

Figure 8A:
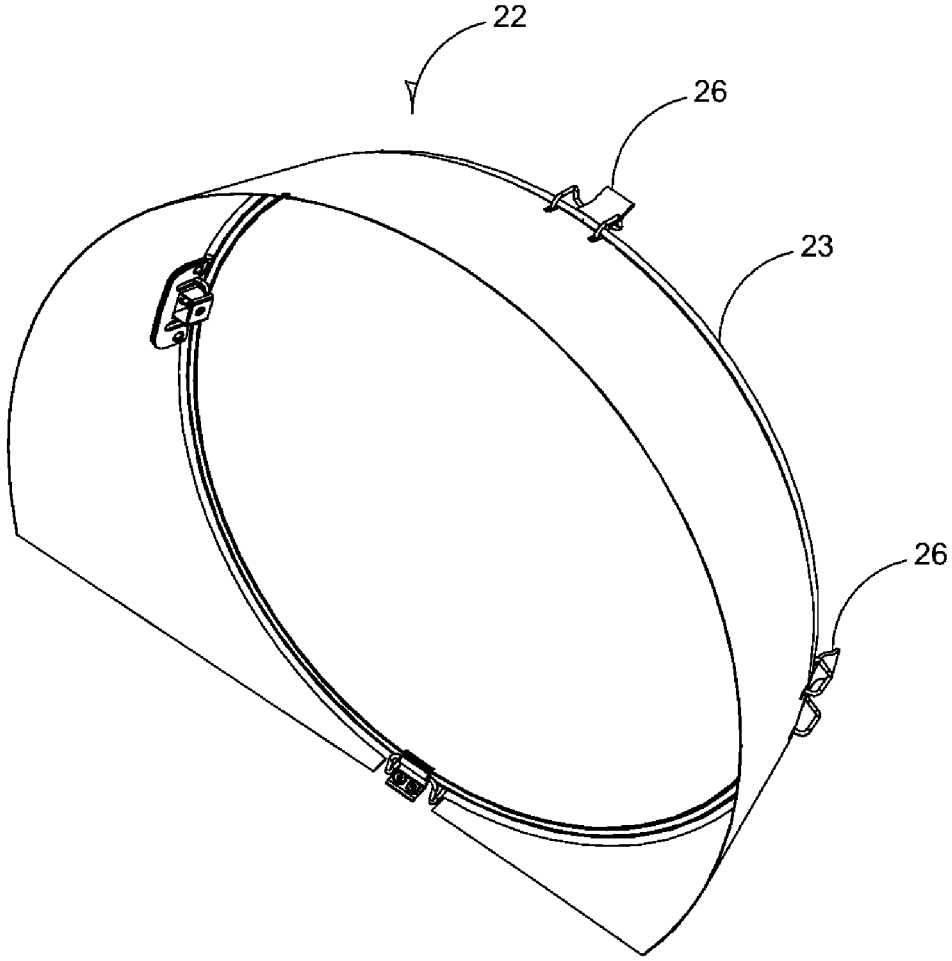
FIG. 8A is a perspective view of a base portion of an exemplary embodiment of a visor according to the present invention.
Figure 8B:
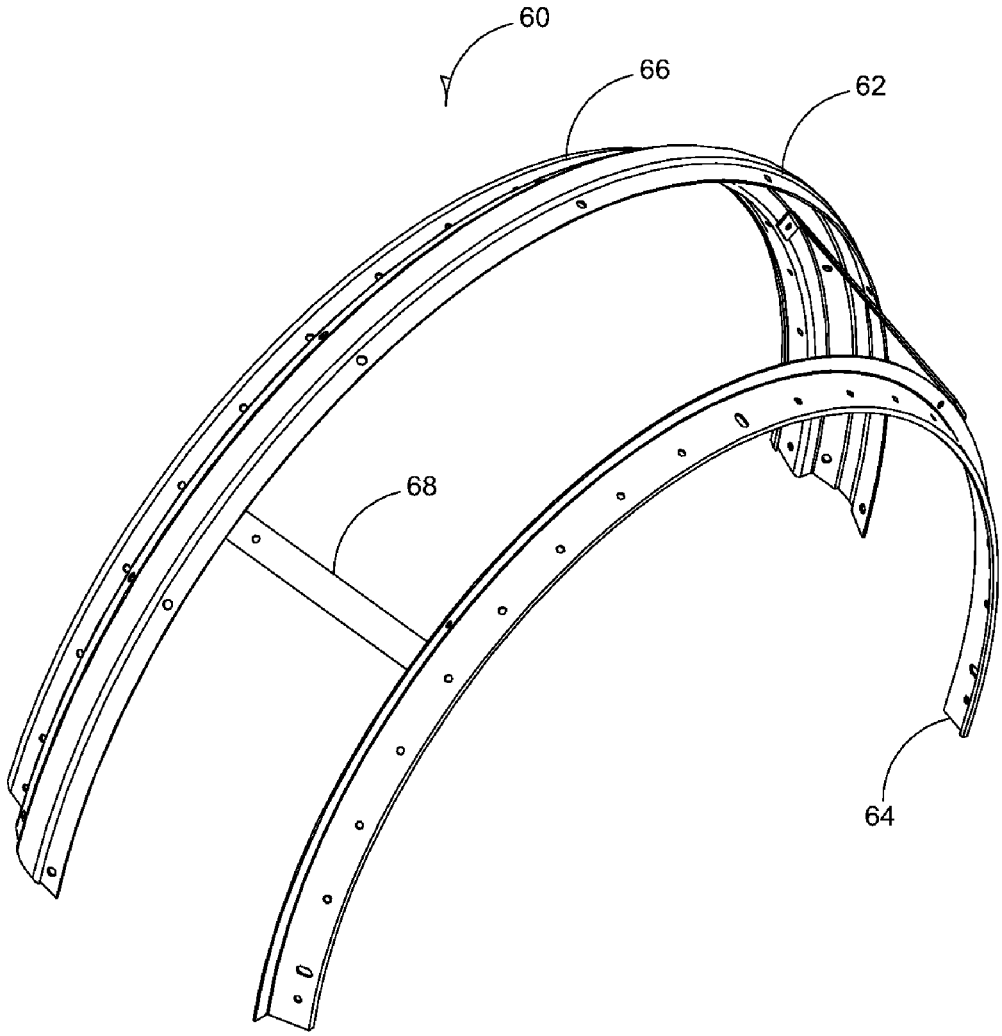
FIG. 8B is a perspective view of a frame assembly for insertion into the base portion of FIG. 8A.
Figure 8C:
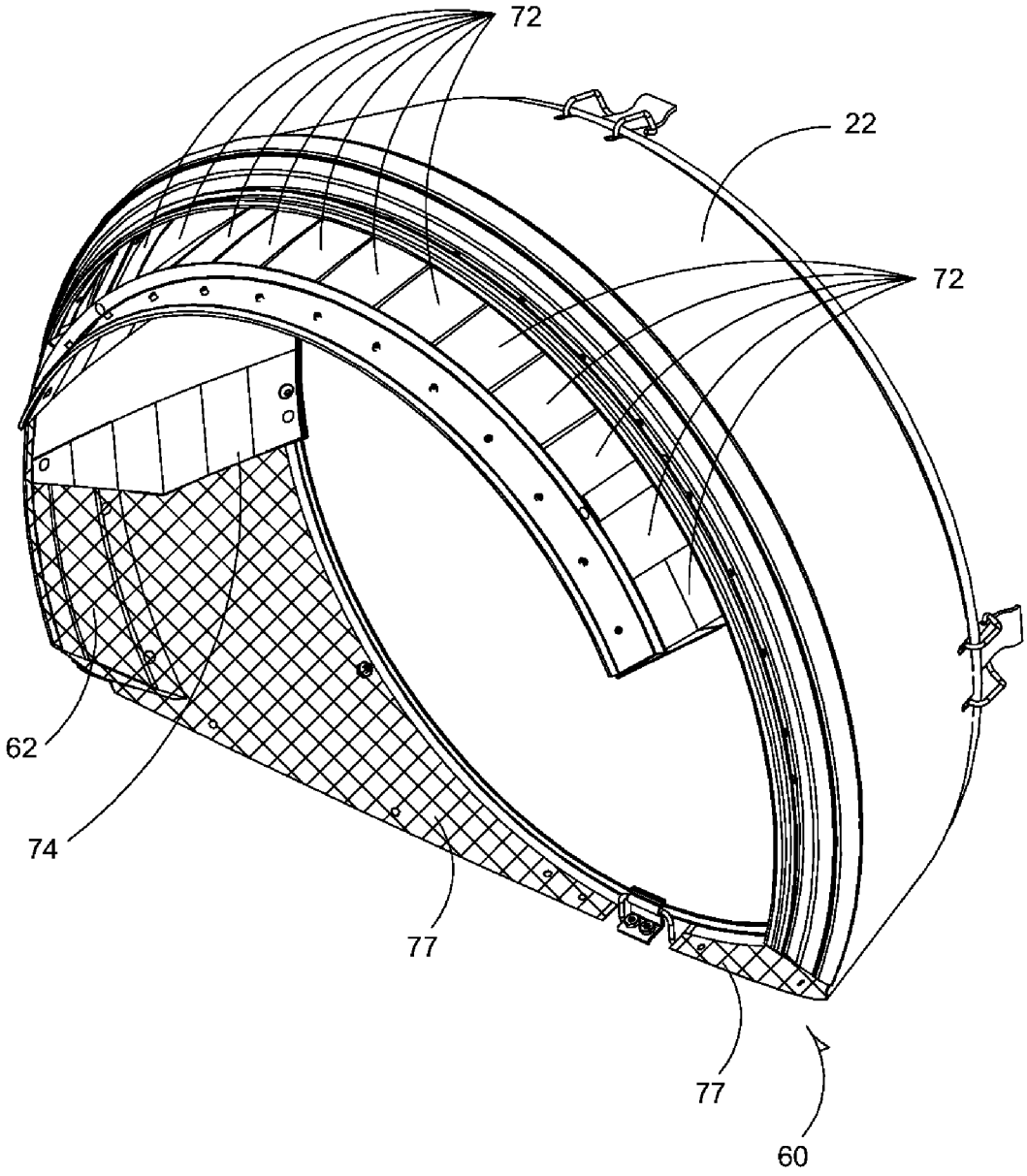
FIG. 8C is a perspective view of the frame assembly and base portion of FIGS. 8A and 8B assembled with highly reflective surfaces attached to the frame assembly.
Figure 9A:
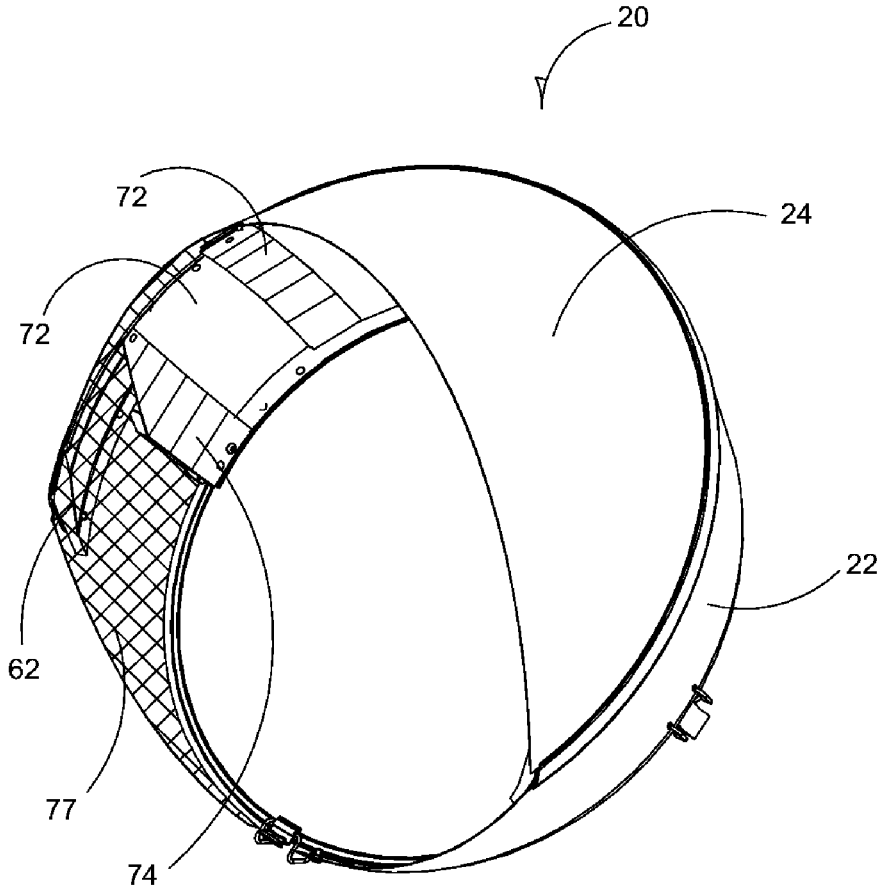
FIG. 9A is a perspective view of the assembled visor with parts of FIGS. 8A-8D.
Figure 9B:
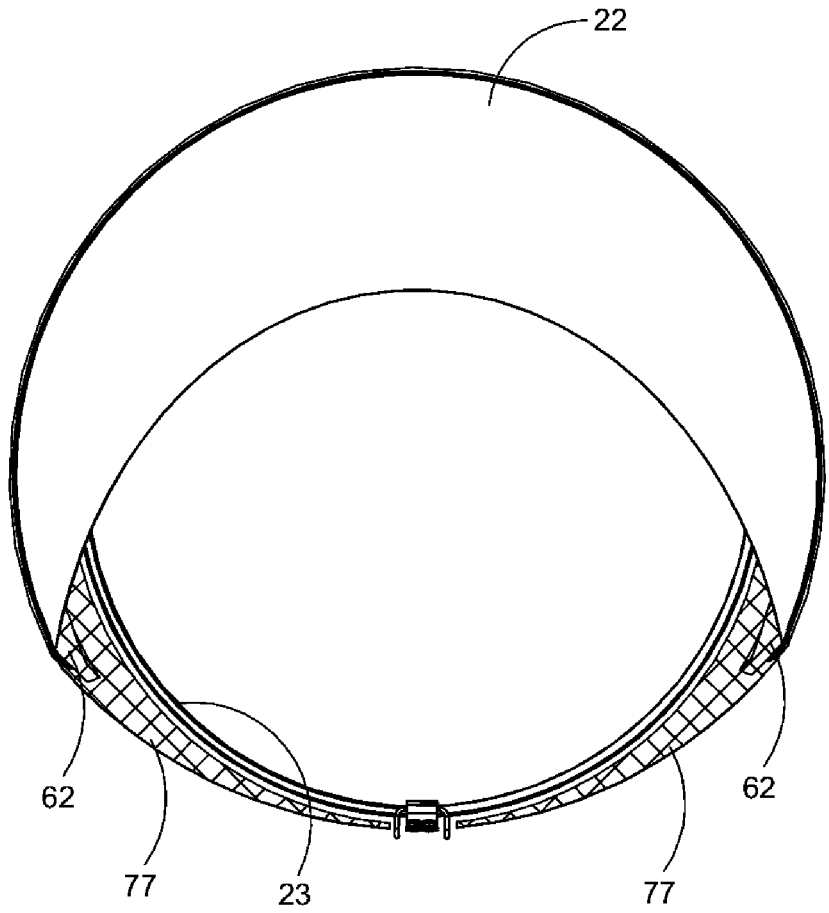
FIGS. 9B-9E are isometric front elevation, side elevation, top plan, and bottom plan views, respectively, of the visor of FIG. 9A.
Figure 9C:
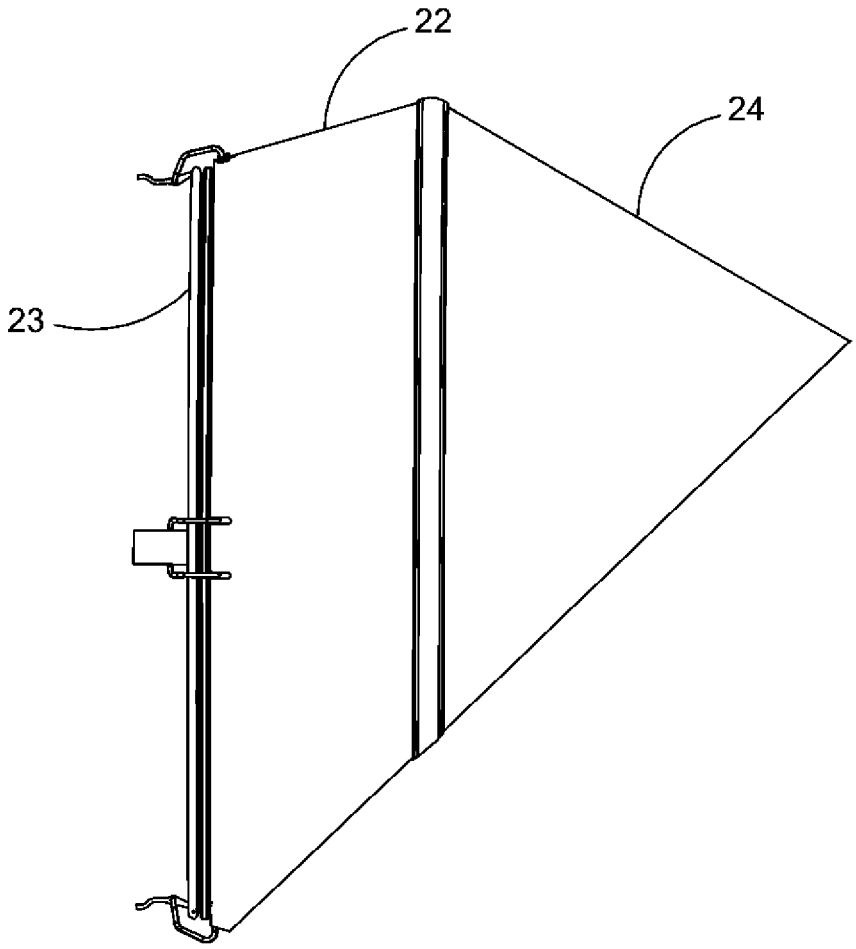
Figure 9D:
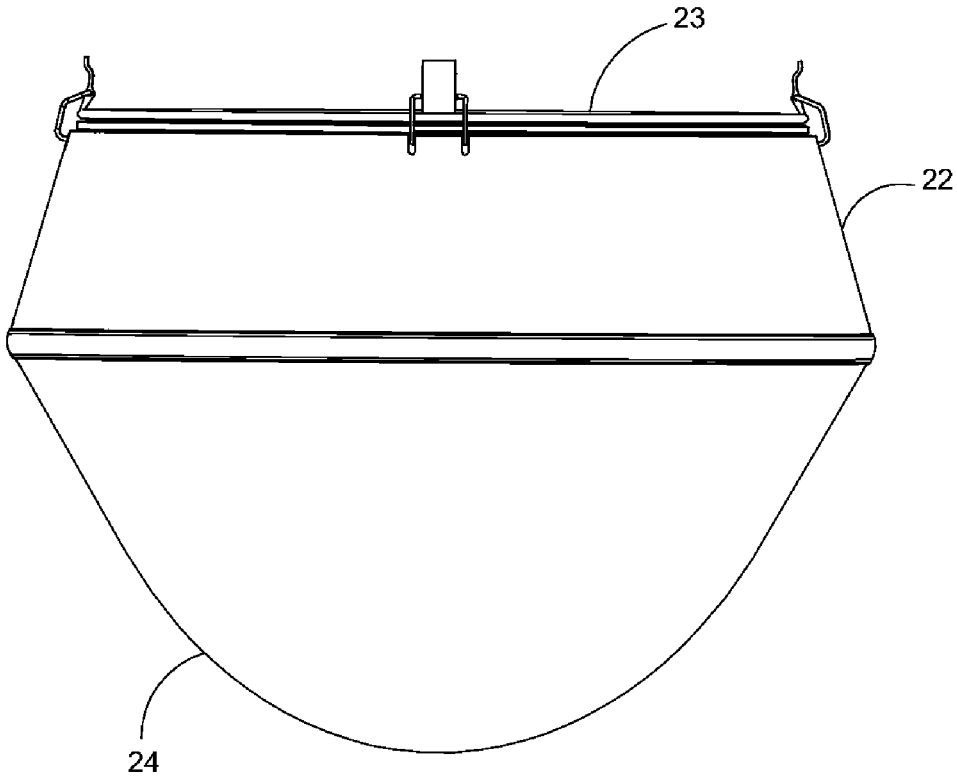

Third, as indicated by the cross-hatched areas (e.g., indicating in this embodiment black paint or surface) in FIGS. 8C, 9A, and 9C are non-reflective areas on visor 20. In this embodiment, there are also highly reflective visor portions 72 and 74 which occupy a substantial portion of the interior of visor 20. In this embodiment one, as shown by the cross-hatched areas 73, 75, and 77 in FIGS. 8C, 9A, 9B, 9C, and 9E versus highly reflective areas 72 and 74, most of the interior surface of base portion 22 is covered by reflective material (here highly reflective). The blackened portions are mainly at the bottom opposite ends of portion 22; whereas at least approximately the upper 180° of the interior of portion 22 is reflective. In contrast, as perhaps best seen in FIG. 9E, roughly one-half of the interior of visor extension 24 is blackened (its most distal side) and roughly one-half is reflective (in this example covered with highly reflective material). These proportions can be varied, of course, according to need or desire. The black surfacing is not reflective and absorbs light. For example, portion 73 of the interior of visor 20 in FIG. 9E would be painted black from at or near the forward edge of reflective surface 72 all the way to the distal perimeter edge of visor 20. But also, parts of visor 20 not covered by side reflective inserts 74 would also be black-surfaced (e.g., painted black) (see ref. no. 75 in FIG. 9E). Also, some surfaces towards the inside bottom of visor 20 (see reference no. 77 in FIGS. 9A and B) would be black.

Note also that parts of the frame 60 that are exposed (e.g., the lower ends of part 62) can also be black (or otherwise be made non-reflective). This is shown by cross-hatching in FIGS. 8C, 9A, 9B, 9E, and 11A.

It can therefore be appreciated that by design of the placement of reflective surfaces 72 and 74, and their resulting percentage coverage of the interior of visor 20, flexibility and control of how much and the nature of light from reflector 20 to the target can be controlled. Furthermore, it can be appreciated by appropriate design, and by selection of the nature of the black surfaces and black insert 30, the amount of light attenuation (and the areas of visor 20 where light is attenuated) can be controlled.

4. Combination of Visor and Non-Reflective Surfaces

These modifications (visor 20, insert 30 and black surfaces in the interior of visor 20), when combined, result in a fixture that has no light intensity visible above horizontal, either direct or reflected, when the light fixture 10 is aimed at standard aiming angles, such as 30° to 45° down from horizontal (see FIGS. 2, 4), and 6A-C. The modifications inside fixture 10 attenuate or absorb light that normally comes from those portions of fixture 10. While this usually results in some minimal reduction of light (less than 10%) coming from fixture 10, it can achieve the benefit of full cut-off for the fixture, even at normal aiming angles for large area lighting applications (e.g., sports lighting). As can be appreciated from FIG. 7, at fixture aiming angles of e.g., 30° and greater down from horizontal (or 60° up from nadir, see 60° line in FIG. 7) full cut-off can be achieved. See how the resulting beam (oval at bottom left side of athletic field or target area 42) substantially is restrained to field 42, and is not substantially off-field or above horizontal.

Figure 4:
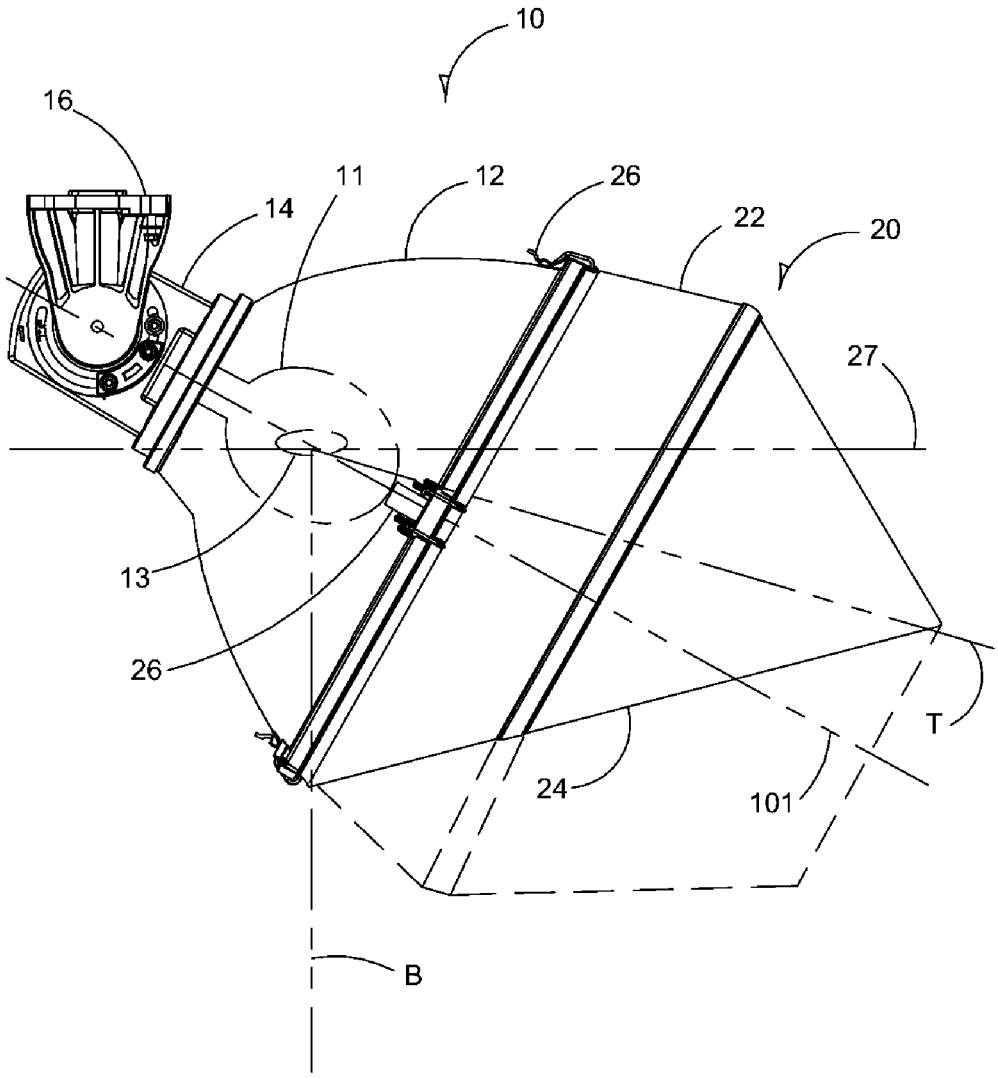
FIG. 4 is a side elevation view of the fixture of FIG. 1A with diagrammatical illustration of make-up of visor 20.
Figure 5:
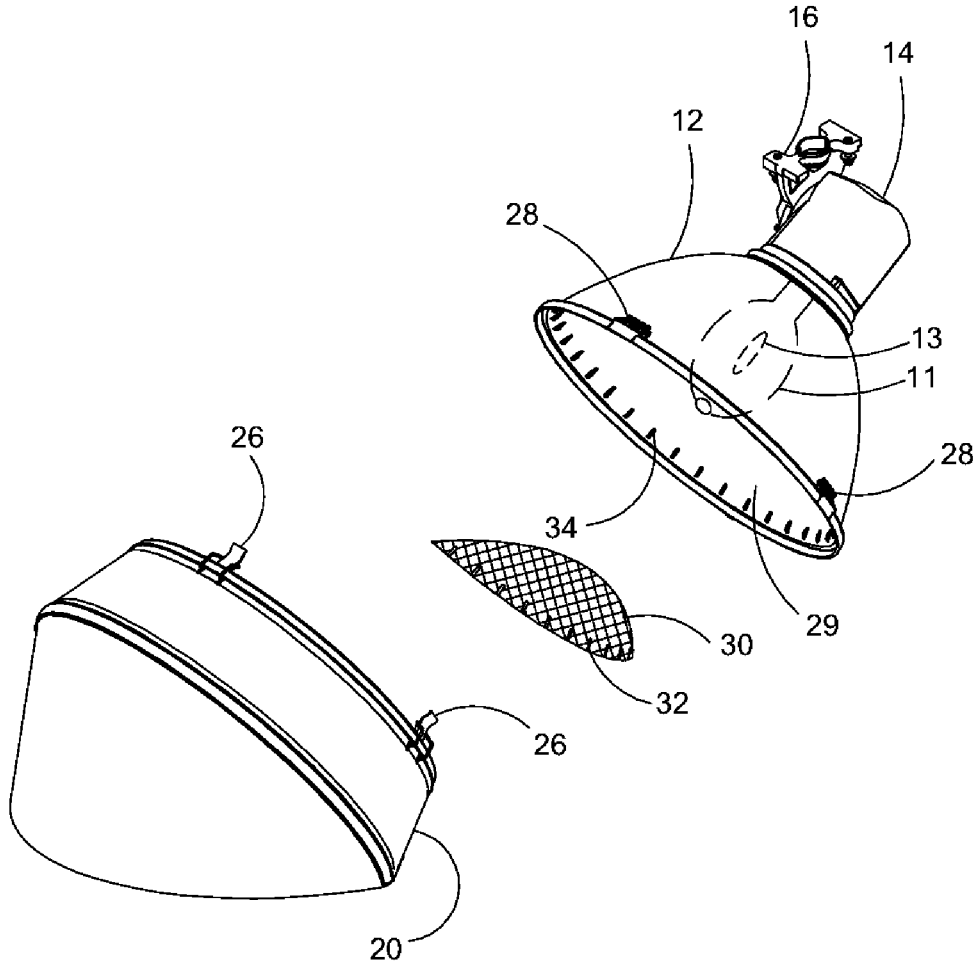
FIG. 5 is an exploded perspective view of the fixture of FIG. 1A.
Figure 6A:
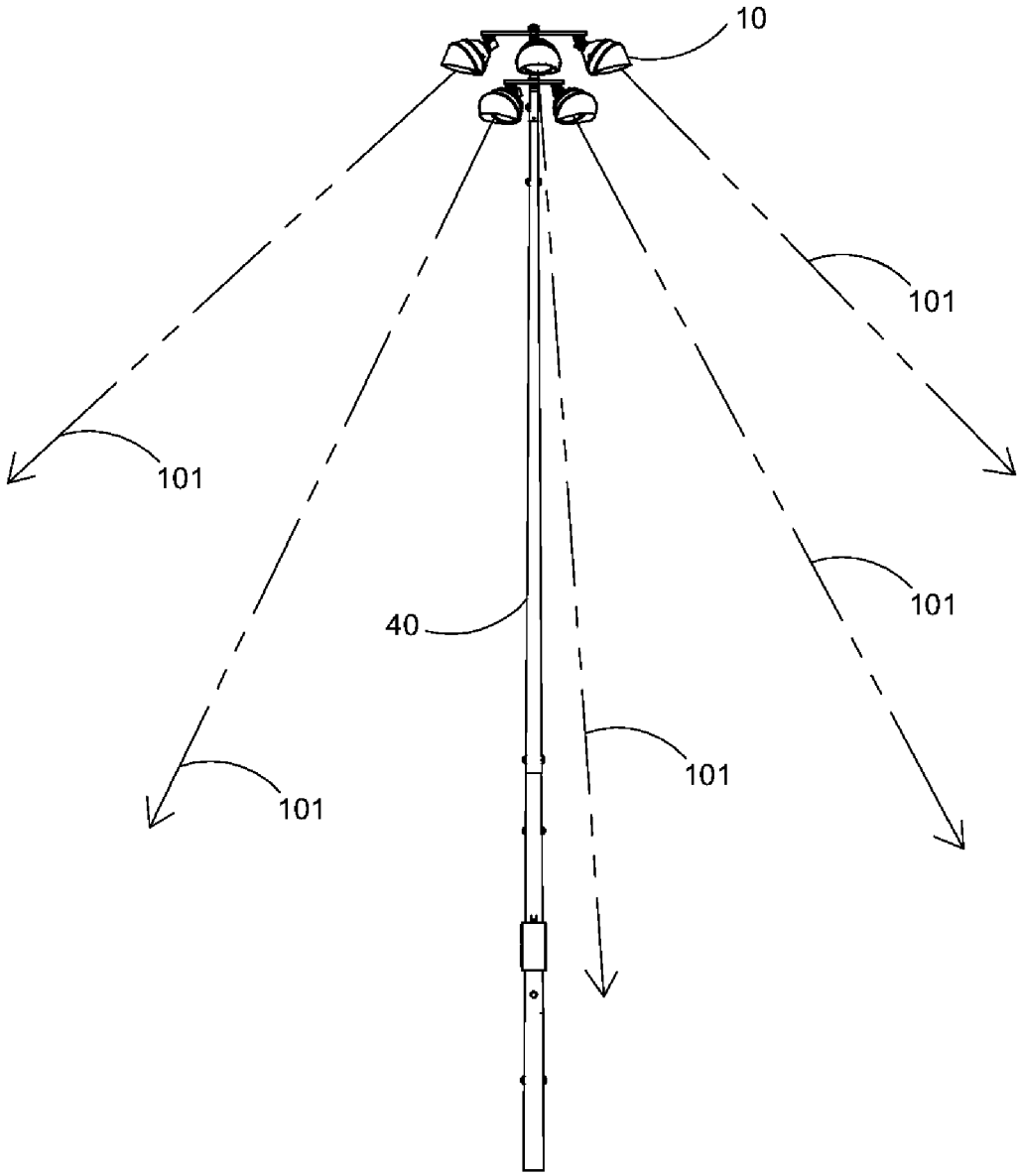
FIGS. 6A-C are perspective views, from different directions, of a plurality of fixtures of FIG. 1A in a conventional operating configuration on a pole.
Figure 6B:
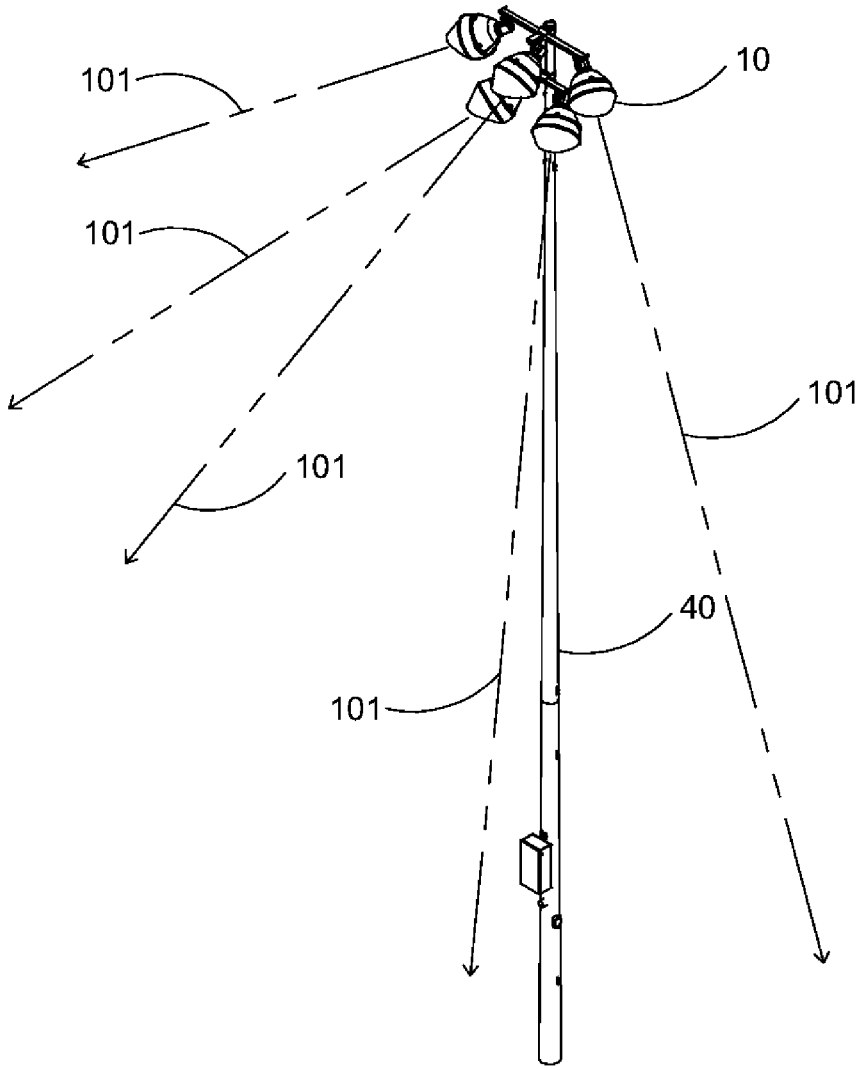
Figure 6C:
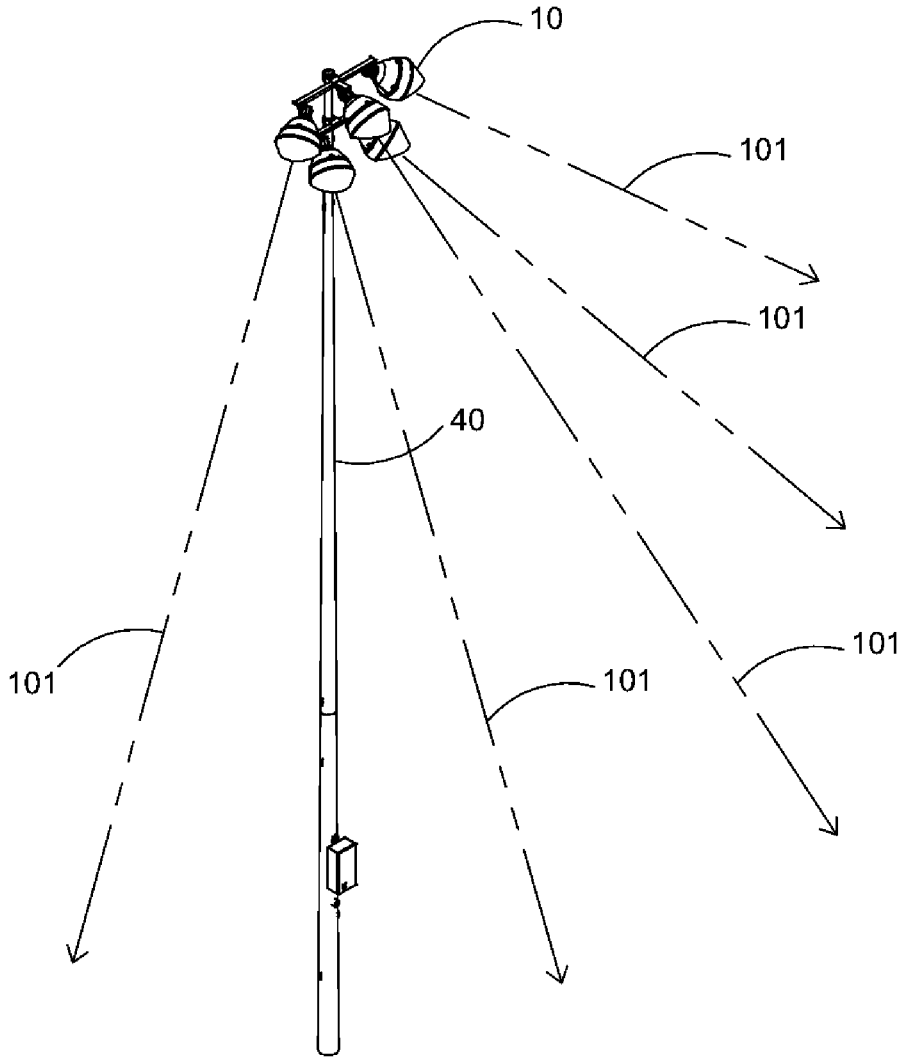

By looking at the figures, particularly FIGS. 2 and 4, it can be seen that the lower edge of visor 20 (see portions 77) wrap around very low on bowl-shaped portion 12 on both sides, cutting off light in the left and right lateral directions (see FIG. 2 lines L and R). FIG. 4 shows how visor 20 can cut off light at top and bottom (see lines T and B). Therefore, it also blocks almost all off-field viewing of the interior of or light source 13 in bowl-shaped reflector 12; even from the sides. Essentially, at most normal viewing angles, the viewer would look at the black insert 30 and the black surfaces 77 on the inside of fixture 10. Wrap-around visor 20 hides from most normal viewing angles direct view the light source (HID arc tube 13 or lamp 11) or the main, exposed, highly-reflective surface 29 of reflector frame 12, and presents to the viewer only black surfaces. The absorption of light by these blackened surfaces essentially eliminates glare at normal viewing angles. But further, the black insert 30, the blackened surfaces 73, 75, and 77, and the shape of visor 20 cooperate to prevent light from directly or by reflection producing any intensity at or above 90° above nadir, or producing intensity above the definition of full cut of the IESNA Lighting Handbook or IESNA Publication RP-33-99 between 80° and 90° above nadir (see FIG. 7). Black insert 30 and black surfaces 73, 75, and 77 absorb and do not reflect incident light from arc tube 13 which otherwise might reflect in a manner to produce intensity above the full cut-off definition levels.

Figure 7:
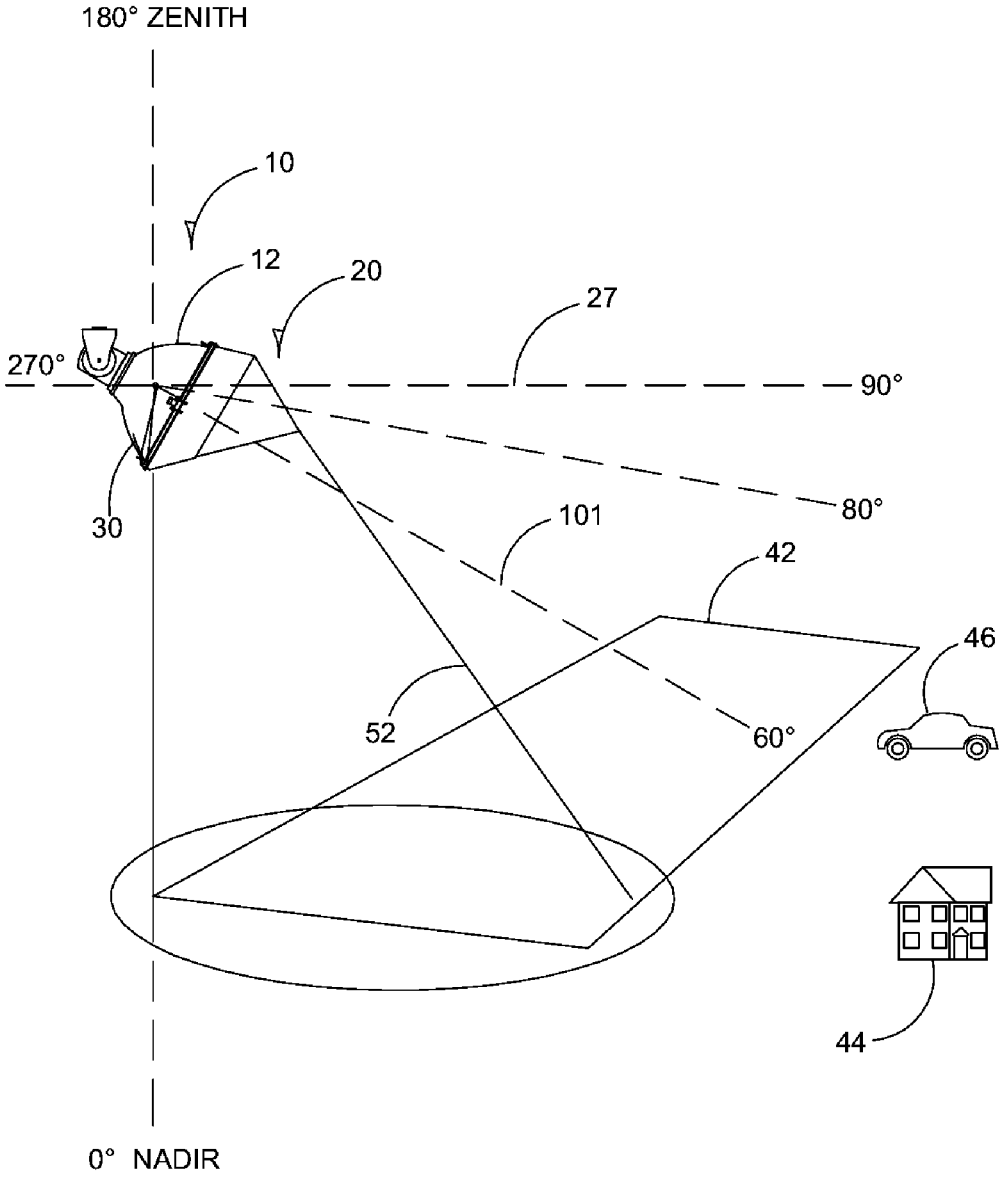
FIG. 7 is a diagram illustrating light control functions of the fixture of FIG. 1A relative to a sports field.

As can be appreciated by the diagram of FIG. 7, insert 30 (see also FIGS. 5 and 11A-B) is configured to absorb light from the light source, minimizing the light reflected in an upward direction. Insert 30 also would help reduce or eliminate glare perceived by an off-field viewer of that part of the interior of bowl shaped reflector 12. Painting surfaces 73, 75, and 77 black absorbs rather than reflects light that could cause light pollution.

In addition to meeting the full cut-off classification as defined by IESNA, as can be seen in FIG. 2, the distal portion 24 of visor 20 almost entirely blocks any view of the inside of reflector 12 at normal viewing angles from the ground. This is especially true when fixtures 10 are in their normal position (see FIG. 6A-6C). They are normally tilted downwardly so that their aiming axis 101 is from 15° to 45° down from horizontal. By extending visor 20 at a sufficient downward angle, it completely blocks any view of the light source by, e.g., spectators, homeowners 44 (FIG. 7), and motorists 46 (FIG. 7) off of the target area 42 (see FIG. 7). This not only reduces spill light to those areas, it can also help reduce or eliminate glare caused by looking at these potentially bright light sources or the highly reflective surface 29 inside reflector frame 12.

Therefore, the above combination is called the full cut-off light because it meets the "full cut-off" classification as defined by IESNA even when aimed at typical lighting aiming angles. As can be seen in FIG. 7, it produces no light above horizontal. It also produces less than 100 cd per 1000 lamp lumens at 80°. It also eliminates a view of the high intensity light source or most highly reflective surfaces in almost any view off the field of the reflecting surface of the bowl-shaped reflector.

The full cut-off visor 20 will prevent, at normal fixture aiming angles, any direct light from the fixture from contributing to sky glow. However, light reflecting off the target surface may still be present and be a source of sky glow (see definition in IESNA Lighting Handbook or other references incorporated by reference herein). The amount of light reflected off the target surface will vary with the type of material. For grass surfaces found in typical sports fields, approximately 10-15% of the amount of light at the surface is reflected back in the air and contributes to sky glow. For what will be referred to from time to time in this description as a near full cut-off fixture according to the present invention, some light off the fixture can contribute to sky glow, but it is generally much less than the amount reflected off the target surface. By "near full cut-off" it is meant that the fixture may not achieve full cut-off according to the IESNA definition referenced earlier, but nearly does.

Figure 9E:
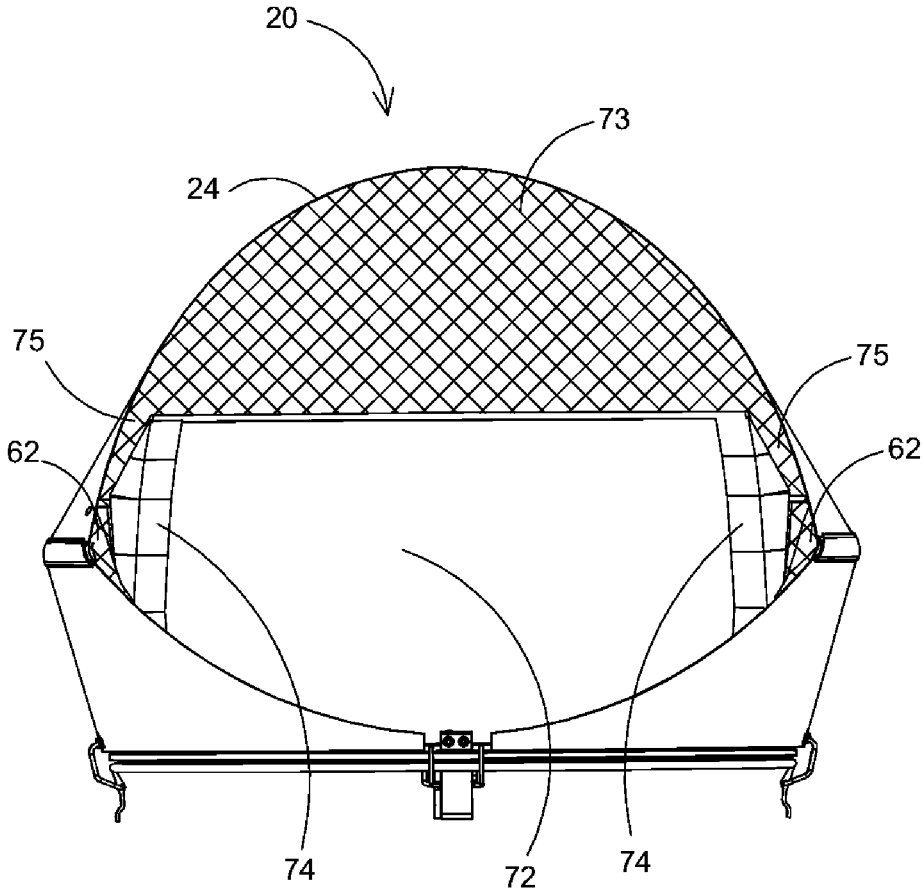

While fixture 10 addresses light pollution, it also tries to prevent major diminution of the amount of usable light coming from the fixture. For example, as can be appreciated by reference to FIG. 11A, black insert 30 only occupies a relatively small percentage of the total intentionally highly reflective surface 29 inside reflector frame 12. And FIGS. 8C and 9E illustrate that blackened surfaces 73, 75, and 77 do not occupy all of the interior surface area of visor 20. To the contrary, reflective surface 29 of reflector frame 12 and reflective surfaces 72 and 74 of the interior of visor 20 reflect (as opposed to absorb) a substantial amount of light from light source 11. Also, their shape, orientation, and other characteristics help capture and control light to the target area instead of blocking it, absorbing it, or allowing it outside the target. The shape of visor 20 essentially presents a wrap-around visor with an opening that tends to face more towards nadir than the open face of frame 12, and be nearer a horizontal plane perpendicular through nadir. This shape, with black surfaces 30, 73, 75, and 77, cooperate to produce full cut-off at fixture angles on the order of 60° above nadir, even though reflector 12 has a central axis 101 that is not pointing at nadir, and is in fact on the order of 60° above nadir. While this results in some loss of efficiency, the loss is not substantial, and certainly less than most prior art attempts at full cut-off at these aiming angles.

5. Assembly of Fixture 10

FIGS. 5, 8A-F, 9A-E, 10A and B, and 11A and B give more detail regarding how visor 20 of exemplary embodiment one is made. Exterior sheet metal is formed into the shape of FIG. 8A. A ring 23 is attached around the rear edge by rivets or other fastening means or methods. Ring 23 includes latch members 26 that can be latched onto latch receivers 28 around the perimeter opening to reflector frame 12.

A frame assembly 60 (FIG. 8B) is created that has a main curved section 62 and spaced apart rim sections 64 and 66 fore and aft of main section 62, with spacers 68 between portions 62 and 64 as shown.

The main curved section 62 is riveted around the front edge of base visor portion 22. A highly reflective shaped surface, or plurality of strips or segments creating such a substantially continuous surface (see reference numeral 72), is mounted on the bottom of frame assembly 60 by rivets, screws, or other fastening means. Highly reflective side sections 74 are similarly mounted on opposite sides of section 72 (see FIG. 9E).

Thus, as shown in FIG. 8C, the base portion 22 is assembled with highly reflective surfaces 72 and 74. Surfaces 73, 75, and 77 are painted black (or otherwise made non-reflective).

An extension visor portion 24 (FIG. 8D) is then riveted or otherwise attached to main curved section 62 on its side opposite base section 22. Extension 24 has depending arms 76 (e.g., rolled metal) that are used to help support and secure it along the lower wrap-around portions 77.

Figure 8D:
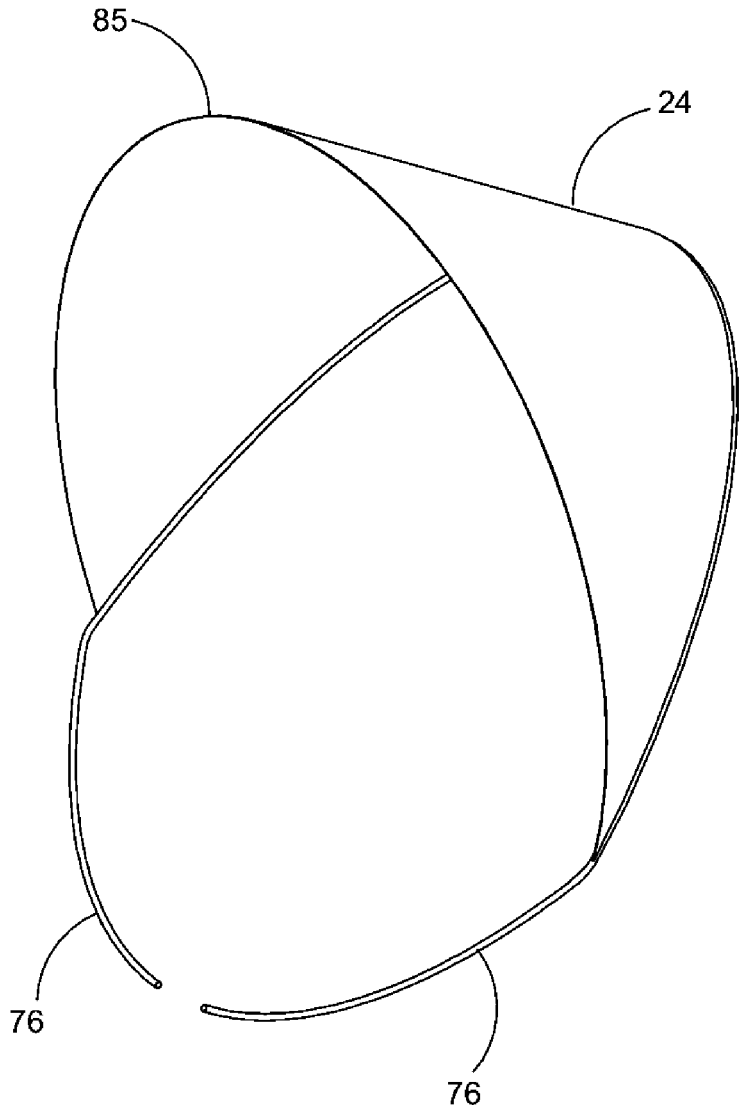
FIG. 8D is a perspective view of an extension visor portion for attachment to the base portion of FIG. 8A.
Figure 8E:
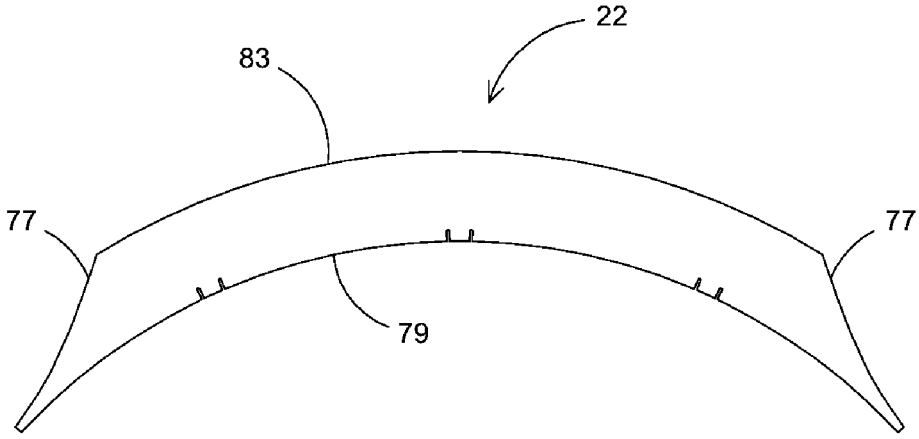
FIG. 8E is a flat pattern or pre-formed plan view of the base portion of FIG. 8A.
Figure 8F:
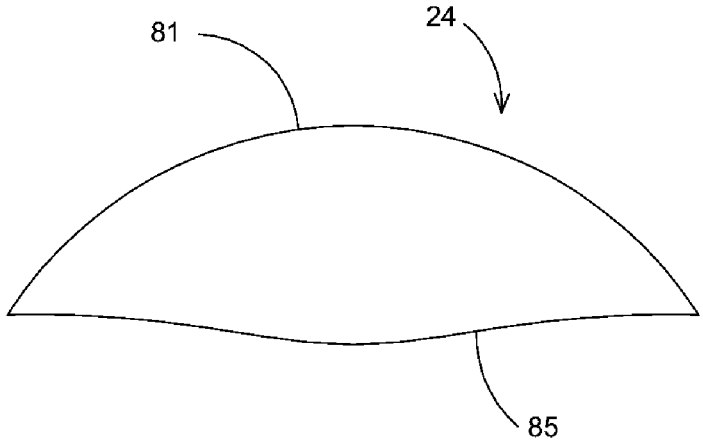
FIG. 8F is a flat pattern or pre-formed plan view of the extension visor portion of FIG. 8D.

FIGS. 8E and 8F illustrate base portion 22 and extension visor portion 24 in flat pattern views (before forming into the shapes of FIGS. 8A and 8D respectively). The components in the Figures are to scale.

As can be seen in Figures, base portion 22 in flat pattern (see FIG. 8E), is sheet metal cut into the shown pattern. The main portion is slightly curved but has a substantially consistent radial width. Note ears 77 on opposite sides narrow to distal ends. Flat pattern 22 of FIG. 8E is formed into the shape of FIG. 8A. The lower edge 79 in FIG. 8E would follow the outer perimeter of the open face of reflector frame 12. It wraps essentially 360° of that perimeter but, as shown in the Figures, between lines L and R in FIG. 2 the width of base portion 22 narrows. Upper edge 83 follows the same curve as lower edge 79 except at opposite ends.

As can also be seen, extension visor portion 24 of FIG. 8D begins as a flat cut-out from sheet metal (see flat pattern of FIG. 8F). It can optionally have a reinforced rolled edge and opposite rolled curved arms 76 that are attached by rivets or fasteners to edge 81. The flat pattern of FIG. 8F would be formed into the shape of FIG. 8D. The top edge 81 of piece 24 in FIG. 8F would be mounted adjacent the top edge 83 of piece 22 of FIG. 8E as shown in FIGS. 9A-C, for well over 180° of the base portion 22. The arms 76 would assist in mounting piece 22 and its structural robustness. Edge 85 is the distal or free edge when assembled.

The Figures show the basic portions, shapes, curvatures, and features of this embodiment of visor 20 for a reflector frame of the Green Generation Lighting® type fixture commercially available from Musco Corporation. Examples of these types of fixtures and different two piece visors can be seen at published U.S. Applications US 2006/0181875 and US 2006/0181882, incorporated by reference herein. The differences of those visors and that shown and described herein can be seen by comparing, for example, FIGS. 8-13 of US 2006/0181875 and FIGS. 9-15 of US 2006/0181882 with FIGS. 8-11 herein.

Notice how when pieces 22 and 24 are assembled with framework to reflector frame 12, pieces 22 and 24 present a "hood" shape with an open bottom defined basically by a plane that intersects at or near the bottom of reflector frame 12. Base portion 22 wraps at least 230°, and almost 360°, around the perimeter of the open face of reflector frame 12, and extends out and radially expanding slightly. Extension member 24 then extends out but down to that plane. Note that it is curved laterally relevant to the open face of reflector frame 12. This has been found to not only allow full or near cut off of light at normal aiming angles, but also to not increase, and many times decrease wind load experienced by the fixture compared to similar fixtures without a visor or with visors not of the configuration of visor 20. As can be appreciated, at normal aiming angles, the flat lens over the open face of reflector frame 12 is shielded by the laterally curved visor extension member 24. This can deflect wind or aerodynamically improve the fixture's handling of wind. The transition from member 24 to almost 360° wrapped base portion 22, with the rounded exterior of reflector frame 12 also can contribute to this benefit.

FIGS. 9A-E show an assembled visor 20 with the pieces of FIGS. 8A-8F. As can be seen, the highly reflective surfaces 72 and 74 do not, in this embodiment, cover the entire interior of visor 20. A substantial part of the interior of extension 24 is not so covered. Areas or surfaces 73, 75, and 77 would be painted black or otherwise be highly light absorbing and not reflective. In this manner, by design and placement of reflecting surfaces 72 and 74, incident light can be carefully controlled. The light from surfaces 72 and 74 can be used in a highly efficient manner for the lighting of the target area of fixture 10 instead of simply blocking it or dispersing it. But incident light to surfaces 73, 75, and 77 would be absorbed.

Figure 10A:
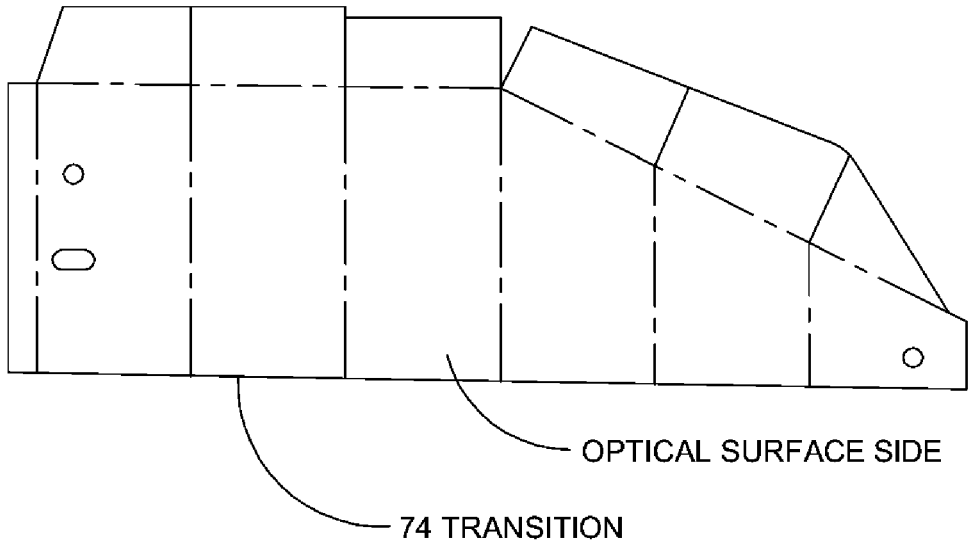
FIG. 10A is a flat pattern or flat plan view before forming of a side reflective surface insert strip ("74 transition") that is added to opposite sides of the visor of FIG. 9A and transitions between center reflective surface 72 and side reflective surface 74.
Figure 10C:
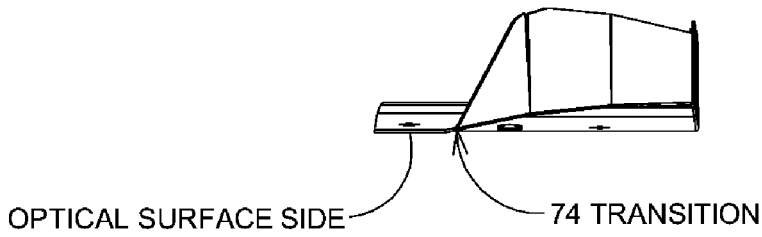
FIG. 10C is an end view from the direction of line 10C-10C of FIG. 10B.
Figure 10B:
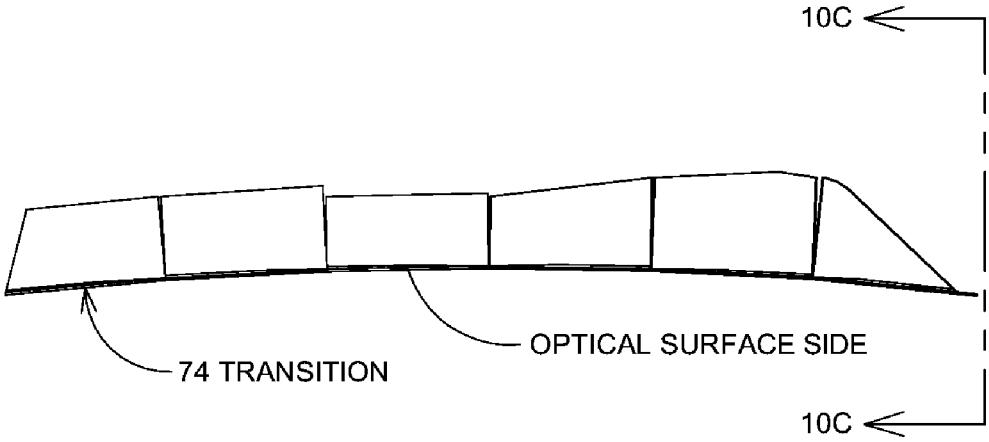
FIGS. 10B and C are an edge view and end view of "74 transition" after forming. The left side of FIG. 10B is the perpendicular transition section between 74 and 72.

FIGS. 10A-C illustrate one example of side reflective pieces 74. It is to be noted that side reflective pieces 74, as well as reflective piece 72, can be made highly reflective by using high reflectivity material. An example would be high reflectivity material under the brand name Anolux Miro® IV anodized lighting sheet material (commercially available from Anomet, Inc. of Brampton, Ontario, CANADA) (high total reflectance of at least 95%). Another example is silver-coated aluminum (from Alanod Aluminum of Emnetepal, GERMANY) (e.g., on the order of 98% or so total reflectance). The latter material may have an even greater reflectivity (on the order of 98%) but may not be as durable as the former mentioned material. Other materials would be possible. Thus, instead of just blocking light incident on the interior of the visor 20 or reflecting in an uncontrolled or inefficient (e.g., high loss) manner, light can be captured and a substantial amount redirected to the target to increase efficiency of the fixture.

Figure 11B:
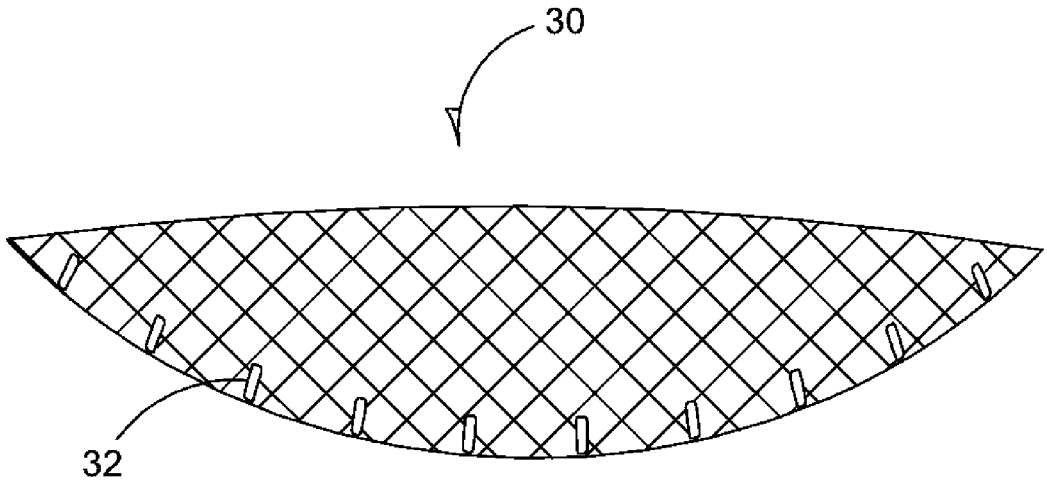
FIG. 11B is an enlarged plan view of the optional member of FIG. 11A.
Figure 12:
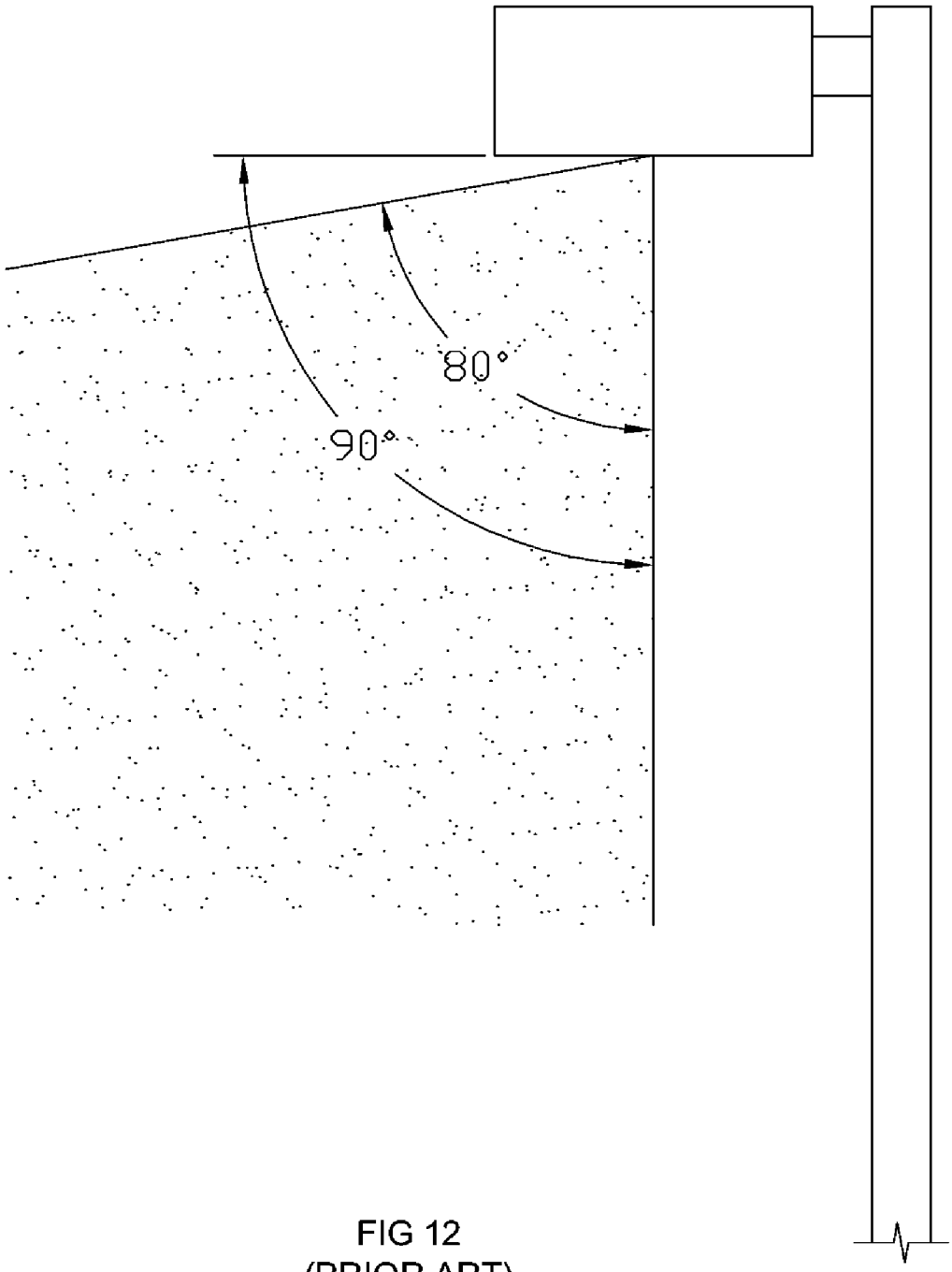
FIG 12 (PRIOR ART)
FIG. 12 is an example of a full cutoff light fixture that is commonly available.

FIG. 11A shows insert 30 in combination with the blackened surfaces 62 and 77 of visor 20. As indicated in previous figures, snap-in insert 30 (FIG. 11B) is finished in black (e.g., painted black) and can be added to the lower reflecting surface of reflector frame 12. FIG. 11B shows one exemplary shape of insert 30. In this embodiment, reflector frame 12 has die-cast bosses, tabs, or pins 34 around its interior perimeter edge (see FIG. 5). Formed openings 32 in insert 30 can interference-fit over bosses, tabs, or pins 34. The tabs 34 extending into openings 32 can secure insert 30 in place. It can, however, be removed. It can therefore be quickly essentially "snapped-in" by removing the typical glass lens from reflector frame 12, lining it up on pins 34, and gently pressing down along openings 32. An example of this snap-in mounting can be found in published U.S. Application 2006/0187663, incorporated by reference herein.

Insert 30 can function to reduce glare. As illustrated in FIG. 11A, someone viewing directly into fixture 10 without insert 30 might see perceived brightness because they can see the interior, highly-reflective surface of fixture 10. Visor 20 would block the upper hemisphere but the exposed part of the interior fixture 10 could be in direct line of sight. Placing blackened surface insert 30 would reduce glare without substantially reducing the light output from fixture 10. Although insert 30 would reduce some light out of fixture 10, as the blackened surface would absorb some light (and thus there would be some efficiency loss), insert 30 is an optional feature that could be used for at least certain fixtures that have specific glare problems because of direct line of sight viewing of the bottom of the fixture by fans, neighbors 44, drivers 46, or others in and around the target area (e.g., sports field 42) and adjacent areas, as indicated in FIG. 7.

The Figures show the following general relationships relative to Embodiment 1. The main reflector or reflector frame 12 has an open face having a perimeter basically in a face plane. Interior reflecting surface 29 basically comprises one or more surface(s) of revolution (e.g., parabloid, hyperboloid, etc., or combination of any of the same) relative central axis 101 which is generally normal to and extends out of the open face. Member 12 has opposite lateral sides on opposite sides of a medial plane through central axis 101. Member 12 has opposite upper and lower sides on opposite sides of a lateral plane through central axis 101 and which is generally orthogonal to the medial plane.

Visor 20 comprises a first or base portion 22 extending from a proximal side around a substantial majority of the perimeter of the open face generally concentrically a distance outwardly along central axis 101 to a distal side. A second portion or visor extension 24 has a proximal side extending a distance outwardly from the distal side of first portion 22 to a distal side.

First and second portions 22 and 24 are basically each truncated cones, with parts removed, that are connected cone base to cone base. The smaller end of partial truncated cone 22 is attached to the perimeter of the open face of reflector frame 12. The smaller end of partial truncated cone 24 is the very distal end of visor 20.

In this embodiment, partial truncated cone 22 is formed from a 15° cone and partial truncated cone 24 is formed from a 30° cone. FIG. 4 indicates with dashed lines what full truncated cones would look like relative to portions 22 and 24 to help visualize how portions 22 and 24 relate to surfaces of base-to-base truncated cones. The dashed lines also indicate the parts of full truncated cones that are missing from portions 22 and 24 that make up the main exterior of visor 20. A second lateral plane at approximately 45° to the lateral plane through central axis 101, and which is tangential to the very bottom of the open face of reflector frame 12, and extends in the direction of the upper distal end of member 24, defines the dashed lines versus the solid lines that illustrate portions 22 and 24.

The relative sizes of portions 22 and 24 to reflector frame 12 in this embodiment are roughly as follows. The depth from edge 79 to edge 83 of portion 22 is about one-half the depth of reflector frame 12 from the plane of its open face to its back end along central axis 101. The depth from edge 81 to edge 85 of portion 24 is about the same as the depth of reflector frame 12 from the plane of its open face to its back end along axis 101.

In this embodiment, further features include that reflector or reflector frame 12 is generally bowl shaped, both exterior and interior. First portion 22 of visor expands relative to the central axis (e.g. in this embodiment first portion 22 expands at around 15° from the central axis 101). Note also how first portion 22 occupies at least 230° around the open face of reflector frame 12, centered at the top of the open face of reflector or reflector frame 12. Ears 77 (see FIG. 8C) on first portion 22 extend around the remainder of the 360° of the open face but narrow from the width of the main section of first portion 22. These ears help block some view of the interior of reflector 12.

The substantial majority of the perimeter of second portion 24 extends from at least 230° of the distal side of first portion 22, centered at the top of the open face of reflector or reflector frame 12 (see, e.g., FIG. 9C).

As can be appreciated, the specific relationships mentioned above relative to the embodiment one illustrated in the Figures can be varied according to need or desire. These relationships are intended to provide the ability for full cut off from a fixture 10 that is aimed down from horizontal at or near 30°. The proportions shown in the drawings can be used to discern the physical size of the parts of visor 20 relative to frame 12, and relative to a Green Generation Lighting® fixture reflector frame 12. The position of the light absorbing surfaces, and their proportionality, can also be seen from the Figures.

B. Exemplary Embodiment Two

Another embodiment according to an aspect of the present invention will be called a near full cut-off fixture. Embodiment two is very similar to embodiment one except for the following.

First, insert 30 is not used. Therefore, the portion of reflector 12 in embodiment one that is covered by insert 30 and absorbs incident light would now, instead, be highly reflective.

Second, portions labeled 73, 75, and 77 on the interior of visor 20 would not be black. For example they can be gray (or some other less light absorbing surface than black) instead of black. This would be less light absorbing than black, but would still not be highly reflective.

The shape of visor 20 would remain the same. The combination of embodiment two (visor 20 and surfaces 73, 75, and 77 painted gray) can produce near full cut-off, or at least substantial cut-off and/or light pollution control. Embodiment two can use the same basic structure except for those changes in surfaces.

Like embodiment one, embodiment two would have some efficiency loss (less light would be available for use at the target). However, it helps reduce light that would otherwise travel above the plane defining a full cut-off fixture and efficiency loss of embodiment two would be less than embodiment one because insert 30 is not used and surfaces 73, 75, and 77 are not black.

The exterior surfaces of fixture 10, including the exterior of visor 20, can also be painted gray in embodiment two (as well as embodiment one). Other colors or surfaces can be used.

C. Options and Alternatives

It is to be appreciated the invention can take different forms, embodiments, and configurations. Variations obvious to those skilled in the art will be included within the invention. A few examples of options and alternatives are set forth below.

Visor 20 could be used without insert 30, or visa versa.

The shape of visor 20 can vary. The shape in the drawings has been found to be relatively aerodynamic and not materially increase wind load of fixture 10. The Figures represent the basic shape and proportions of the components.

Visor 20 utilizes some principles of the highly reflective lighting fixture visor incorporated by reference in U.S. published applications, 2006/0181882 and 2006/0181875 A1. Further details regarding how the visor components could be assembled are set forth in that published application. Reference to published application 2006/0187663 also provides additional details regarding an example of reflector frame 12, mounting bosses or pins 34, and highly reflective add-on reflecting material. However, different configurations of reflective surfaces 72 and 74 are possible. One form surfaces 72 and 74 could take are individual elongated highly reflective strips that mount adjacent to one another. Trapezoidal-shaped strips could be mounted all the way around the interior of reflector frame 12. Also, highly reflective surface 72 could actually be side-by-side rectangular strips 72 (see FIG. 8C). Highly reflective surface 74 could likewise be side-by-side strips 74 and "74 transition". Strip "74 transition" is shown in detail in FIGS. 10A and B. It would be the nearest strip of surface 74 to surface 72, includes a bent portion that creates a transition or step between surfaces 74 and 72 (on each side of 72).

Materials for the components of the fixture can be selected according to desire or need. In the embodiments described above, when the lighting fixture is tilted downward from horizontal approximately 30° (its central axis 101 is approximately 30° down from horizontal or 60° up from nadir), plane 27 (see FIG. 7) generally through visor 20 is generally horizontal. Plane 27 illustrates that a substantial amount of light from source 13 would be intercepted by the interior of visor 20. Embodiment one of fixture 10 deters uplight for fixtures aimed around 30° or more down from horizontal, and can produce full cut-off for fixtures aimed as shallow as 33° down from horizontal; and maybe less (e.g., 29°-32°). Embodiment two can achieve cut-off at those angles, and can achieve full cut-off at steeper than those angles, at least in some configurations.

Fixture 10 can almost completely block direct line of sight view of the interior highly reflecting surface of reflector frame 12. It can almost completely block the view not only from the front but the sides because the sides tend to extend down to that horizontal plane. This can substantially cut off light to locations beyond the target area. This can therefore solve some spill light issues. As previously discussed, the fixture can also address some glare issues.

By referring to FIG. 7, the indicated horizontal plane 27 is generally 90° above nadir. Fixture 10 is shown at an aiming angle 60° up from nadir. As can be appreciated, from side view, the bottom of visor 20 extends below and somewhat parallel to plane 27. This helps cut light off from traveling above plane 27. The insert 30 and black painted surfaces 73, 75, and 77 absorb light. As will be appreciated, if fixture 10 in FIG. 7 was aimed at steeper angles, the full cut-off criteria could more easily be met. It is to be understood that in the prior art, one conventional way to try to create a full cut-off fixture is to aim the fixture very steeply. The closer it approaches pointing directly to nadir (straight down) is usually better for cut-off (e.g., see FIG. 12). However, this drastically reduces the lighting applications for such fixtures. It reduces the ability to aim the beam from the fixture at shallower angles to farther distances. Therefore, one feature of the present invention is that it allows for full cut-off or near full cut-off for conventional sports lighting aiming angles on the order of 30° down from horizontal (60° up from nadir). It furthermore allows for full cut-off or near full cut-off for aiming angles that are shallower than conventional sports lighting angles. As can be appreciated in FIG. 7, even if fixture 20 was aimed at a shallower angle, visor 20 and its components could attenuate light going above the horizontal plane to achieve at least some light pollution control.

Visor 20 can be utilized as needed or desired. It is particularly effective at steeper aiming angles for fixtures like fixture 10 (e.g., where it is aimed down at least on the order of 30° or more). It can be used for wide area lighting such as sports field lighting where spill and glare light control is important. Other uses include parking lots, train yards, and the like. At angles previously discussed, this fixture 10 with visor 20 can be a valuable alternative to conventional shoe box type parking lot lights.

The light source can be any of a variety of sources including but not limited to high pressure sodium or other high intensity discharge lamps. Visors 20 can be added to any of a number of different types of light fixtures over and above that shown in the drawings.

What is claimed is:

1. A visor for a high intensity discharge wide area lighting fixture comprising a bowl shaped reflector or reflector frame having a generally circular lens opening, and a central aiming axis comprising:

a. a visor body having a proximal side adapted for connection to the lens opening of the lighting fixture;

b. the visor body extending at or near 180° in opposite directions around the lens opening;

c. the visor extending outwardly a distance from the proximal side around the lens opening and downwardly to a distal side defining an outlet opening that is essentially in a plane that intersects with the bottom of the lens opening and forms an acute angle with the central aiming axis and the lens opening of the fixture.

2. The visor of claim 1 wherein the bottom plane is approximately 45° from the aiming axis of the fixture.

3. The visor of claim 1 further in combination with a lighting fixture reflector frame having an interior reflecting surface.

4. The combination of claim 3 further comprising an insert placed in the lower hemisphere of the reflecting surface of the reflector body, the insert being substantially light absorbing.

5. The visor of claim 1 further comprising a base portion for connecting to the fixture, the base portion comprising essentially an elongated sheet bent to correspond to the perimeter edge of the fixture and a visor extension portion, wherein a generally triangular plan section of sheet material is bent to follow the curvature of the base portion.

6. The visor of claim 5 further comprising a frame assembly having a first interface connecting the base portion and the extension portions of the visor, and supplementary portions to support highly reflective reflecting surface or surfaces on the interior of the visor.

7. The visor of claim 6 where the highly reflective surfaces are configured to precisely capture and control light.

8. The visor of claim 4 further comprising light absorbing surfaces for other than the reflective surfaces inside the visor.

9. A method for control of light from a lighting fixture having a lens over a fixture face, the lens having a top, bottom and sides generally in a lens plane comprising:

a. installing the fixture with lens opening not parallel to a target surface in a normal operating position;

b. extending a visor substantially all 360° from the lens plane of the lighting fixture outwardly and downwardly to create essentially a hood having a visor opening generally in a visor opening plane that intersects at or near the bottom of the lens and extends outwardly at an acute angle with the lens plane.

10. The method of claim 9 further comprising absorbing light in a portion of the lighting fixture.

11. The method of claim 10 wherein the step of absorbing light comprises a black surface.

12. The method of claim 9 wherein the visor opening plane is near horizontal when the fixture is in normal operating position.

13. A method for adjustable level of light control from a light fixture comprising a generally substantially bowl-shaped reflecting surface with a high intensity discharge light source, the fixture having a central aiming axis extending out of an opening of the fixture, comprising:

a. adding a base visor member around the opening to the fixture and extending substantially outwardly a distance from close to the entire perimeter of the opening of the fixture;

b. adding an extension member to the base visor member, the extension member extending further outward and angularly towards the center aiming axis of the fixture a selected distance;

c. so that by selection of the size and configuration of the extension member, the level of light control can be adjusted.

14. The method of claim 13 further comprising the base member being substantially flat and of roughly equal width projection on a flat surface, and the extension generally triangular when projected to a flat surface with the base of the generally triangular portion attached to the base visor member of the visor.

15. The method of claim 13 further comprising a high reflectance surface in an interior portion of the base visor member and/or the extension member.

16. The method of claim 13 further comprising light blocking and/or absorbing surfaces on an interior portion of one or both of the base visor member and the extension member of the visor.

17. The method of claim 13 further comprising modifying an interior lower portion of the fixture reflective surface to (a) block or absorb light and/or (b) reflect light in a diverging manner from the central axis of the fixture.

18. The method of claim 13 further comprising blocking and controlling light from the fixture so that it does not travel above a horizontal plane at the fixture when the fixture is operatively installed and aimed approximately 30° or more below horizontal.

19. An apparatus for adjustable level of light control from a lighting fixture including a generally bowl-shaped reflective surface having a lower hemisphere, high intensity discharge lamp, and an opening, comprising:

a. a base visor member having a distal edge attached around the opening of the fixture and extending generally outward;

b. an extension member having a proximal edge attached to the distal edge of the base member and extending outwardly and downwardly relative to the base member;

c. a portion of the interior of the base visor member and/or the extension member including high reflectance material;

d. a portion of the base visor member and/or the extension member comprising a light absorbing or blocking material.

20. The apparatus of claim 19 further comprising an insert placed in the lower hemisphere of the fixture reflecting surface, the insert comprising light blocking or absorbing material.

21. A method of wide area lighting with relatively high efficiency but with at least substantial light control comprising:

a. generating an asymmetrical light beam from a fixture comprising a surface of revolution reflective member, an opening, and a high intensity light source;

b. blocking, with an extended visor, light that otherwise would travel above a horizontal plane at the fixture when the fixture is in operating position aimed at approximately 30° or more down from horizontal, wherein a substantial part of a lower one-half of the interior of the base member and extension are of light absorbing or blocking surface and an approximately upper one-half are of high reflectance surface;

c. blocking or absorbing light in a bottom part of the fixture reflective member;

d. so that no light intensity is visible above horizontal directly or indirectly when the fixture is in the operating position of approximately 30° or more down from horizontal.

22. The method of claim 21 wherein a substantial part of a lower one-half of the interior of the base member and extension are of light absorbing or blocking surface and an approximately upper one-half are of high reflectance surface.

23. The method of claim 21 wherein the blocking or absorbing comprises an insert which extends approximately 60° in a bottom of the reflective member towards its perimeter.

24. The apparatus of claim 21 wherein the shape and angle of extension and base member relative the fixture promotes improved aerodynamics for the fixture and visor.

25. A lighting fixture for high intensity, wide area lighting to a relatively distance target comprising:

a. a main reflector or reflector frame comprising:

i. an open face having a perimeter;

ii. an interior reflecting surface comprising a surface of revolution relative a central axis which generally normal to and extends out of the open face;

iii. opposite lateral sides on opposite sides of a medial plane through the central axis;

iv. opposite upper and lower sides on opposite sides of a lateral plane through the central axis and which is orthogonal to the medial plane;

b. a visor comprising;

i. a first partial truncated cone portion extending from a proximal side around a substantial majority of the perimeter of the open face generally a distance outwardly along the central axis to a distal side;

ii. a second partial truncated cone portion having a proximal side extending a distance outwardly from the distal side of the first portion to a distal side;

iii. a bottom opening defined by a plane through the first and second truncated cone portions forming an acute angle with the transverse plane, and intersecting at or near the bottom of the open face at or near the medial plane;

iv. so that the visor provides an exterior side which covers a substantial amount of the open face of the reflector or reflector frame, provides a curved surface in generally lateral directions, but presents an opening tilted downward and generally at the lower side of the reflector or reflector frame.

26. The lighting fixture of claim 25 wherein the reflector or reflector frame is generally bowl shaped.

27. The lighting fixture of claim 25 wherein the first portion of visor expands relative to the central axis.

28. The lighting fixture of claim 27 wherein the first portion of visor expands at around 15° from the central axis.

29. The lighting fixture of claim 25 wherein the substantial majority of the perimeter of the first portion comprises at least 230° centered at the top of the open face of the reflector or reflector frame.

30. The lighting fixture of claim 29 further comprising ears on the second portion extending around the remainder of the 360° of the open face.

31. The lighting fixture of claim 25 wherein the acute angle of the plane defining the bottom opening of the visor is approximately 45°.

32. The lighting fixture of claim 25 wherein the substantial majority of the perimeter of the second portion comprises at least 230° centered at the top of the open face of the reflector or reflector frame.

33. The lighting fixture of claim 25 wherein the surface of revolution of the second portion comprises the shape of an exterior of a truncated cone having a base.

34. The lighting fixture of claim 33 wherein the first portion comprises the shape of an exterior of a truncated cone, the base of which is adjacent the base of the second portion.

35. The lighting fixture of claim 25 further comprising a portion of the reflecting surface of the reflector or reflector frame at or near the bottom side comprising a light absorbing or attenuating surface.

36. The lighting fixture of claim 25 wherein the visor has an interior and an exterior, the interior comprising a portion comprising a light absorbing or attenuating surface.

37. The lighting fixture of claim 25 wherein the visor has an interior and an exterior, the interior comprising a portion comprising a light reflective surface adapted to reflect incident light in a controlled manner.

38. The lighting fixture of claim 25 mounted on an elevating structure.

39. The lighting fixture of claim 38 wherein the elevating structure comprises a pole.

40. The lighting fixture of claim 38 wherein the fixture is mounted so that the central axis is between 15 and 45 down from horizontal when in operating position.

41. The lighting fixture of claim 38 wherein the fixture is mounted at approximately 30° down from horizontal.

42. The lighting fixture of claim 25 wherein the reflector or reflector frame has a depth, the first portion has a depth, and the second portion has a depth, all relative the central axis, and the depth of the first portion being approximately one-half the depth of the reflector or reflector frame, and the depth of the second portion being about the same as the depth of the reflector or reflector frame.

* * * * *

UNITED STATES PATENT AND TRADEMARK OFFICE

CERTIFICATE OF CORRECTION

PATENT NO. : 7,918,588 B2
APPLICATION NO. : 12/114553
DATED : April 5, 2011
INVENTOR(S) : Gordin et al.

It is certified that error appears in the above-identified patent and that said Letters Patent is hereby corrected as shown below:

Col. 16, Claim 40, Line 39:
ADD after 45 -- ° --

Signed and Sealed this
Thirty-first Day of May, 2011

David J. Kappos

David J. Kappos
*Director of the United States Patent and Trademark Office*